US007478540B2

(12) United States Patent
Flynn et al.

(10) Patent No.: US 7,478,540 B2
(45) **Date of Patent: *Jan. 20, 2009**

(54) METHODS OF FREEZEOUT PREVENTION AND TEMPERATURE CONTROL FOR VERY LOW TEMPERATURE MIXED REFRIGERANT SYSTEMS

(75) Inventors: Kevin P. Flynn, Novato, CA (US); Mikhail Boiarski, Macungie, PA (US); Oleg Podtcherniaev, Odintsovo (RU)

(73) Assignee: Brooks Automation, Inc., Chelmsford, MA (US)

( * ) Notice: Subject to any disclaimer, the term of this patent is extended or adjusted under 35 U.S.C. 154(b) by 371 days.

This patent is subject to a terminal disclaimer.

(21) Appl. No.: 11/349,060

(22) Filed: Feb. 7, 2006

(65) Prior Publication Data

US 2006/0168976 A1 Aug. 3, 2006

Related U.S. Application Data

(63) Continuation-in-part of application No. 11/332,495, filed on Jan. 13, 2006, now abandoned, which is a continuation of application No. 12/281,881, filed on Oct. 28, 2002, now Pat. No. 7,059,144.

(60) Provisional application No. 60/335,460, filed on Oct. 26, 2001.

(51) Int. Cl.
*F25B 41/00* (2006.01)
*F25B 49/00* (2006.01)
*F25J 1/00* (2006.01)

(52) U.S. Cl. ..... 62/196.4; 62/197; 62/612; 62/114

(58) Field of Classification Search ..... 62/196.4, 62/612, 114, 197
See application file for complete search history.

(56) References Cited

U.S. PATENT DOCUMENTS

| | | | | |
|---|---|---|---|---|
| 3,733,845 | A | | 5/1973 | Lieberman |
| 3,768,273 | A | * | 10/1973 | Missimer ..... 62/84 |
| 4,084,405 | A | | 4/1978 | Schibbye et al. |
| 4,122,688 | A | | 10/1978 | Mochizuki et al. |
| 4,258,553 | A | | 3/1981 | Kelly et al. |
| 4,506,521 | A | | 3/1985 | Asano et al. |

(Continued)

FOREIGN PATENT DOCUMENTS

EP 0 516 093 12/1992

(Continued)

OTHER PUBLICATIONS

International Search Report for PCT/US2007/002518 filed Jan. 31, 2007.

(Continued)

*Primary Examiner*—William C Doerrler
(74) *Attorney, Agent, or Firm*—Hamilton Brook Smith & Reynolds PC

(57) ABSTRACT

Refrigerant freezeout is prevented, and temperature is controlled, by the use of a controlled bypass flow that causes a warming of the lowest temperature refrigerant in a refrigeration system that achieves very low temperatures by using a mixture of refrigerants comprising at least two refrigerants with boiling points that differ by at least 50° C. This control capability enables reliable operation of the very low temperature system.

21 Claims, 7 Drawing Sheets

U.S. PATENT DOCUMENTS

| | | | |
|---|---|---|---|
| 4,535,597 | A | 8/1985 | Missimer et al. |
| 4,535,598 | A | 8/1985 | Mount |
| 4,562,700 | A | 1/1986 | Atsumi et al. |
| 4,597,267 | A | 7/1986 | Forrest |
| 4,763,486 | A | 8/1988 | Forrest et al. |
| 4,831,835 | A | 5/1989 | Beehler et al. |
| 4,926,658 | A | 5/1990 | Olsen et al. |
| 4,986,084 | A | 1/1991 | Beckhusen |
| 5,056,327 | A | 10/1991 | Lammert |
| 5,087,381 | A | 2/1992 | Tamura et al. |
| 5,170,639 | A | 12/1992 | Datta |
| 5,182,920 | A | 2/1993 | Matsuoka et al. |
| 5,265,443 | A | 11/1993 | Yuzawa et al. |
| 5,337,572 | A | 8/1994 | Longsworth |
| 5,339,654 | A | 8/1994 | Cook et al. |
| 5,396,777 | A | 3/1995 | Martin |
| 5,408,848 | A | 4/1995 | Weng |
| 5,425,890 | A | 6/1995 | Yudin et al. |
| 5,441,658 | A | 8/1995 | Boyarsky et al. |
| 5,579,654 | A | 12/1996 | Longsworth et al. |
| 5,644,502 | A | 7/1997 | Little |
| 5,660,047 | A | 8/1997 | Paganessi |
| 5,702,632 | A | 12/1997 | Weng |
| 5,715,694 | A | 2/1998 | Yakumaru et al. |
| 5,724,832 | A | 3/1998 | Little et al. |
| 5,730,216 | A | 3/1998 | Viegas et al. |
| 5,749,243 | A | 5/1998 | Lester |
| 5,795,453 | A | 8/1998 | Gilmartin et al. |
| 5,946,925 | A | 9/1999 | Williams et al. |
| 6,041,620 | A | 3/2000 | Olszewski et al. |
| 6,041,621 | A | 3/2000 | Olszewski et al. |
| 6,047,556 | A | 4/2000 | Lifson |
| 6,053,008 | A | 4/2000 | Arman et al. |
| 6,065,305 | A | 5/2000 | Arman et al. |
| 6,073,454 | A | 6/2000 | Spauschus et al. |
| 6,076,366 | A | 6/2000 | Takano et al. |
| 6,076,368 | A | 6/2000 | Noble |
| 6,076,372 | A | 6/2000 | Acharya et al. |
| 6,089,033 | A | 7/2000 | Dubé |
| 6,105,388 | A | 8/2000 | Acharya et al. |
| 6,112,534 | A | 9/2000 | Taras et al. |
| 6,112,547 | A | 9/2000 | Spauschus et al. |
| 6,112,550 | A | 9/2000 | Bonaquist et al. |
| 6,125,656 | A | 10/2000 | Arman et al. |
| 6,148,634 | A | 11/2000 | Sherwood |
| 6,159,917 | A | 12/2000 | Baran, Jr. et al. |
| 6,167,722 | B1 | 1/2001 | Kasezawa et al. |
| 6,176,102 | B1 | 1/2001 | Novak et al. |
| 6,189,335 | B1 | 2/2001 | Ebara et al. |
| 6,205,818 | B1 | 3/2001 | Seward, III |
| RE37,119 | E | 4/2001 | Sherwood |
| 6,230,519 | B1 | 5/2001 | Arman et al. |
| 6,233,955 | B1 | 5/2001 | Egara |
| 6,253,577 | B1 | 7/2001 | Arman et al. |
| 6,258,292 | B1 | 7/2001 | Turner |
| 6,260,380 | B1 | 7/2001 | Arman et al. |
| 6,269,658 | B1 | 8/2001 | Royal et al. |
| 6,293,106 | B1 | 9/2001 | Archarya et al. |
| 6,293,335 | B1 | 9/2001 | Tawney et al. |
| 6,306,803 | B1 | 10/2001 | Tazaki |
| 6,327,866 | B1 | 12/2001 | Novak et al. |
| 6,330,811 | B1 | 12/2001 | Arman et al. |
| 6,336,331 | B1 | 1/2002 | White et al. |
| 6,357,257 | B1 | 3/2002 | Goble, Jr. et al. |
| 6,374,629 | B1 | 4/2002 | Oberle et al. |
| 6,426,019 | B1 | 7/2002 | Acharya et al. |
| 6,438,994 | B1 | 8/2002 | Rashad et al. |
| 6,474,082 | B2 | 11/2002 | Flynn |
| 6,481,223 | B2 | 11/2002 | Flynn et al. |
| 6,502,410 | B2 | 1/2003 | Podtchereniaev et al. |
| 6,560,981 | B2 | 5/2003 | Flynn |
| 6,574,978 | B2 | 6/2003 | Flynn et al. |
| 6,595,009 | B1 | 7/2003 | Howard et al. |
| 6,644,038 | B1 | 11/2003 | Acharya et al. |
| 6,644,067 | B2 | 11/2003 | Stenhouse |
| 6,722,145 | B2 | 4/2004 | Podtchereniaev et al. |
| 6,830,703 | B2 | 12/2004 | Klug et al. |
| 6,843,065 | B2 | 1/2005 | Flynn |
| 6,886,361 | B2 | 5/2005 | Flynn |
| 7,059,144 | B2 * | 6/2006 | Flynn et al. ..... 62/196.4 |
| 2001/0042379 | A1 | 11/2001 | Flynn et al. |
| 2002/0017106 | A1 | 2/2002 | Flynn et al. |
| 2002/0023447 | A1 | 2/2002 | Podtchereniaev et al. |
| 2002/0035841 | A1 | 3/2002 | Flynn |
| 2002/0134104 | A1 | 9/2002 | Stenhouse |
| 2003/0115893 | A1 | 6/2003 | Flynn et al. |
| 2005/0242323 | A1 | 11/2005 | Leck et al. |

FOREIGN PATENT DOCUMENTS

| | | |
|---|---|---|
| EP | 1 225 400 A1 | 7/2002 |
| JP | 2-195156/90 | 8/1990 |
| JP | 02-242051 | 9/1990 |
| JP | 4-46667/92 | 4/1992 |
| JP | 5-118677 | 5/1993 |
| JP | 05118677 A | 5/1993 |
| JP | 09-318205 | 12/1997 |
| JP | 11-310775 | 11/1999 |
| WO | WO 02/095308 | 11/2002 |
| WO | WO 03/083382 | 10/2003 |

OTHER PUBLICATIONS

In *Refrigeration Volume of ASHRAE Handbook, Refrigerant-Control Devices*, Chapter 45, pp. 45. 1-45.33, 2002.

International Preliminary Report on Patentability for PCT/US2007/002518 filed Jan. 21, 2007, dated Aug. 21, 2008.

* cited by examiner

METHODS OF FREEZEOUT PREVENTION AND TEMPERATURE CONTROL FOR VERY LOW TEMPERATURE MIXED REFRIGERANT SYSTEMS

RELATED APPLICATIONS

This application is a continuation-in-part of U.S. application Ser. No. 11/332,495, filed on Jan. 13, 2006, now abandoned entitled "Methods of Freezeout Prevention for Very Low Temperature Mixed Refrigerant Systems," which is a continuation of U.S. application Ser. No. 10/281,881, filed on Oct. 28, 2002, now U.S. Pat. No. 7,059,144 which claims the benefit of U.S. Provisional Application No. 60/335,460, filed on Oct. 26, 2001. The entire teachings of the above applications are incorporated herein by reference.

FIELD OF THE INVENTION

This invention relates to processes using throttle expansion of a refrigerant to create a refrigeration effect.

BACKGROUND OF THE INVENTION

Refrigeration systems have been in existence since the early 1900s, when reliable sealed refrigeration systems were developed. Since that time, improvements in refrigeration technology have proven their utility in both residential and industrial settings. In particular, low-temperature refrigeration systems currently provide essential industrial functions in biomedical applications, cryoelectronics, coating operations, and semiconductor manufacturing applications.

There are many important applications, especially industrial manufacturing and test applications, which require refrigeration at temperatures below 183 K (−90° C.). This invention relates to refrigeration systems that provide refrigeration at temperatures between 183 K and 65 K (−90° C. and −208° C.). The temperatures encompassed in this range are variously referred to as low, ultra low and cryogenic. For purposes of this application the term "very low" or "very low temperature" will be used to mean the temperature range of 183 K and 65 K (−90° C. and −208° C.).

In many manufacturing processes conducted under vacuum conditions, and integrated with a very low temperature refrigeration system, rapid heating is required in certain processing steps. This heating process is commonly refereed to as a defrost cycle. The heating process warms the evaporator and connecting refrigerant lines to room temperature. This enables these parts of the system to be accessed and vented to atmosphere without causing condensation of moisture from the air on these parts. The longer the overall defrost cycle and subsequent resumption of producing very low temperature temperatures, the lower the throughput of the manufacturing system. Enabling a quick defrost and a quick resumption of the cooling of the cryosurface (evaporator) in the vacuum chamber is beneficial to increase the throughput of the vacuum process.

In addition, there are many processes where it is desired to provide a flow of hot refrigerant through the evaporator for an extended period of time. For purposes of this application, we refer to this as a "bakeout" operation. An example of a system using a bakeout operation is found in U.S. Pat. No. 6,843,065, the disclosure of which is incorporated herein by reference. A bakeout operation is beneficial when the element being alternately heated and cooled by the refrigerant has a large thermal mass, and where the temperature response as a function of time is longer than about one to five minutes. In such cases, a prolonged flow of high temperature refrigerant is required to allow thermal conduction of the heat to occur until all surfaces reach the desired minimum temperature. In addition, a common procedure in vacuum chambers is a mode where the surfaces in the chamber are heated to high temperatures, typically of 150° C. to 300° C. Such high temperatures will radiate to all surfaces in the chamber, including the element cooled and heated by the refrigerant. Exposing the refrigerant and any residual compressor oil resident in the element to such high temperatures when no refrigerant flow is occurring through the element presents the risk of overheating the resident refrigerant with consequent decomposition of the refrigerant and/or the oil. Therefore, providing continuous flow of high temperature refrigerant (typically 80 to 120° C.), while the chamber is being heated, controls the temperature of the refrigerant and oil and prevents any possible decomposition.

There are many vacuum processes that have the need for such very low temperature cooling. The chief use is to provide water vapor cryopumping for vacuum systems. The very low temperature surface captures and holds water vapor molecules at a much higher rate than they are released. The net effect is to quickly and significantly lower the chamber's water vapor partial pressure. This process of water vapor cryopumping is very useful for many physical vapor deposition processes in the vacuum coating industry for electronic storage media, optical reflectors, metallized parts, semiconductor devices, etc. This process is also used for remove moisture from food products and biological products in freeze drying operations.

Another application involves thermal radiation shielding. In this application large panels are cooled to very low temperatures. These cooled panels intercept radiant heat from vacuum chamber surfaces and heaters. This can reduce the heat load on surfaces being cooled to temperatures lower than that of the panels. Yet another application is the removal of heat from objects being manufactured. In some applications the object is an aluminum disc for a computer hard drive, a silicon wafer for the manufacture of a semiconductor device, or a material such as glass or plastic for a flat panel display. In these cases, the very low temperature provides a means for removing heat from these objects more rapidly, even though the object's final temperature at the end of the process step may be higher than room temperature.

Further, some applications involving hard disc drive media, silicon wafers, or flat panel display material, or other substrates, involve the deposition of material onto these objects. In such cases heat is released from the object as a result of the deposition and this heat must be removed while maintaining the object within prescribed temperatures. Cooling a surface like a platen is the typical means of removing heat from such objects. In all these cases an interface between the refrigeration system and the object to be cooled is proceeding in the evaporator where the refrigerant is removing heat from the object at very low temperatures.

Still other applications of very low temperatures include the storage of biological fluids and tissues and control of reaction rates in chemical and pharmaceutical processes.

Additional applications include use of very low temperature in the treatment of metals and other materials to control the materials' properties. Yet other applications include heat removal from a wide variety of processes, including but not limited to CCD cameras, X-ray detectors, gamma ray detectors, and other nuclear particle and radiation detectors. Still other applications include instrumentation applications, including gas chromatography, differential scanning calorimetry, mass spectrometry, and other similar applications.

Very low temperature refrigeration is also used in condensing and cooling of consumer and industrial gases and liquids, such as in nitrogen liquefaction, oxygen liquefaction, liquefaction of other gases, and cooling of gases for a wide variety of applications. Some of these include butane chilling, control of gas temperatures in chemical processes, etc.

Conventional refrigeration systems have historically utilized chlorinated refrigerants, which have been determined to be detrimental to the environment and are known to contribute to ozone depletion. Thus, increasingly restrictive environmental regulations have driven the refrigeration industry away from chlorinated fluorocarbons (CFCs) to hydrochlorofluorocarbons (HCFCs). Provisions of the Montreal Protocol require a phase out of HCFC's and a European Union law bans the use of HCFCs in refrigeration systems as of Jan. 1, 2001. Therefore the development of an alternate refrigerant mixture is required. Hydroflurocarbon (HFC) refrigerants are good candidates that are nonflammable, have low toxicity and are commercially available.

Prior art very low temperature systems used flammable components to manage oil. The oils used in very low temperature systems using chlorinated refrigerants had good miscibility with the warmer boiling components that are capable of being liquefied at room temperature when pressurized. Colder boiling HFC refrigerants such as R-23 are not miscible with these oils and do not readily liquefy until they encounter colder parts of the refrigeration process. This immiscibility causes the compressor oil to separate and freezeout, which in turn leads to system failure due to blocked tubes, strainers, valves or throttle devices. To provide miscibility at these lower temperatures, ethane is conventionally added to the refrigerant mixture. Unfortunately, ethane is flammable, which can limit customer acceptance and can invoke additional requirements for system controls, installation requirements and cost. Therefore, elimination of ethane or other flammable component is preferred.

Refrigeration systems such as those described above require a mixture of refrigerants that will not freezeout from the refrigerant mixture. A "freezeout" condition in a refrigeration system occurs when one or more refrigerant components, or the compressor oil, becomes solid or extremely viscous to the point where it does not flow. During normal operation of a refrigeration system, the suction pressure decreases as the temperature decreases. If a freezeout condition occurs, the suction pressure tends to drop even further creating positive feedback and further reducing the temperature, causing even more freezeout.

What is needed is a way to prevent freezeout in a mixed refrigerant refrigeration system. HFC refrigerants available have warmer freezing points than the HCFC and CFC refrigerants that they replace. The limits of these refrigerant mixtures with regard to freezeout are disclosed in U.S. application for patent Ser. No. 09/886,936. As mentioned above, the use of hydrocarbons is undesirable due to their flammability. However, elimination of flammable components causes additional difficulties in the management of freezeout since the HFC refrigerants that can be used instead of flammable hydrocarbon refrigerants typically have warmer freezing points.

Typically freezeout occurs when the external thermal load on the refrigeration system becomes very low. Some very low temperature systems use a subcooler that takes a portion of the lowest temperature high-pressure refrigerant and uses this to cool the high-pressure refrigerant. This is accomplished by expanding this refrigerant portion and using it to feed the low-pressure side of the subcooler. Thus when flow to the evaporator is stopped, internal flow and heat transfer continues allowing the high-pressure refrigerant to become progressively colder. This in turn results in colder temperatures of the expanded refrigerant entering the subcooler. Depending on the overall system design, refrigerant components in circulation at the cold end of the system, and the operating pressures of the system, it is possible to achieve freezeout temperatures. Since margin must be provided relative to such a condition as freezeout, the resulting refrigeration design will often be limited as the overall system is designed to never encounter a freezeout condition.

Another challenge when using hydrofluorocarbons (HFCs) as refrigerants is that these refrigerants are immiscible in alkylbenzene oil and therefore, a polyolester (POE) (1998 ASHRAE Refrigeration Handbook, chapter 7, page 7.4, American Society of Heating, Refrigeration and Air Conditioning Engineers) compressor oil is used to be compatible with the HFC refrigerants. Selection of the appropriate oil is essential for very low temperature systems because the oil must not only provide good compressor lubrication, it also must not separate and freezeout from the refrigerant at very low temperatures.

U.S. application for patent U.S. Ser. No. 09/894,964 describes a method of freezeout prevention on a very low temperature mixed refrigerant system as referenced in this application. Although this method proved effective for the systems it was employed on, it was not able to provide the required control. This is because, using a valve to increase the pressure of the upstream low-pressure refrigerant to prevent freezeout reduced the refrigeration performance of the system. The disclosed valve has to be adjusted manually, and it is not practical to adjust it manually as needed for the different modes of operation (i.e. cool, defrost, standby and bakeout).

In general a large number of bypass methods are employed in conventional refrigeration systems. These systems, operating typically at temperatures of −40° C. or warmer, employ a single refrigerant component, or a mixture of refrigerants with closely spaced boiling points that behave similar to a single refrigerant components. On such systems, control methods make use of the correspondence between the saturated refrigerant-temperature and the saturated refrigerant pressure. On single refrigerant components the nature of this correspondence is such that when a two-phase mixture (liquid and vapor phase) is present, only the temperature or pressure of the refrigerant need be specified to know the other. With mixed refrigerant systems commonly employed, with closely spaced boiling points, small deviations occur from this temperature pressure correspondence but they behave and are treated in a similar fashion as single component refrigerants.

The invention disclosed relates to a very low temperature refrigeration system employing a mixed refrigerant with widely spaced boiling points. A typical blend will have boiling points that differ by 100 to 200° C. For the purposes of this disclosure a very low temperature mixed refrigerant system (VLTMRS) means a very low temperature refrigeration system employing a mixed refrigerant with at least two components whose normal boiling points differ by at least 50° C. For such mixtures, the deviations from single refrigerant components are so significant that the correspondence between saturated temperature and saturated pressure is more complicated.

Due to the added number of degrees of freedom provided by these additional components and the fact that these components behave much differently from each other due to their widely spaced boiling points, the refrigerant mixture composition, the liquid fraction, and the temperature (or pressure) must be specified in order for the pressure (or temperature) to be determined. Therefore, control methods from conventional single refrigerant or mixtures with behavior similar to a single refrigerant, cannot be applied to a VLTMRS in the same manner as conventional systems due to this difference in temperature-pressure correspondence. Although similar from a schematic representation the application of these devices in a VLTMRS is different from prior art due the differences in the pressure temperature correspondence.

As a simple example, conventional refrigeration system controls rely heavily on the fact that controlling the condenser temperature will control the discharge pressure. Therefore, a control valve that controls condenser temperature will control the discharge pressure in a very predictable manner regardless of the mode of operation or the thermal load on the evaporator. In contrast, a VLTMRS using components with widely spaced boiling points will experience large changes in the compressor discharge pressure due to changes in the evaporator load and mode of operation, even if the circulating mixture and condenser temperature are unchanged.

Therefore, some of the schematics shown which embody the invention will be familiar to those practiced in conventional refrigeration. An overview of prior art control methods is given in Chapter 45 of the 2002 edition of the Refrigeration Volume of the ASHRAE handbook. The present system differs from these prior art systems in that the application involves refrigerants with different pressure-temperature characteristics, or more specifically, these refrigerants have no determined pressure temperature correspondence, as do conventional refrigerants. Therefore, the interaction of the control components and the refrigerants is different.

Forrest et al., U.S. Pat. No. 4,763,486, describes a VLTMRS that incorporates an internal condensate bypass. In this method, liquid refrigerant from various phase separators in the process is bypassed to the inlet of the evaporator. The stated purpose of this method is to provide temperature and capacity control of the evaporator cooling, and to provide stable operation of the system. As defined, this method requires flow of refrigerant through the evaporator to provide some level of cooling. No mention is made of a standby mode or a bakeout mode and the schematic clearly shows that the methods shown cannot be used in a standby mode or a bakeout mode. This invention describes the difficulty of starting systems with various numbers of phase separators.

Since the time of this patent, many variations of VLTMRS have been demonstrated, with varying numbers of phase separators, with phase separators that were full or partial separators, and with no phase separators. These demonstrated systems have been successfully operated without utilizing Forrest et al. It is possible that conditions being prevented by Forrest et al. relate to the fact that VLTMRS require a minimal flow rate to support proper two-phase flow of refrigerant. Without adequate flow, the symptoms avoided by Forrest et al. would be expected. Also, Forrest et al. does not make use of a discharge line oil separator. It is known that compressor oil in the VLTMRS can lead to blocking of flow passages and lead to the types of symptoms that Forrest et al. seeks to avoid.

Further, the current application prevents freezeout of the refrigerants in the process. Unlike conventional refrigeration systems where this is not a normal concern, since they typically operated 50° C. or warmer than the freezing points of the refrigerants used in the very low temperature systems disclosed, freeze out is an important consideration.

SUMMARY OF THE INVENTION

The present invention discloses methods to provide temperature control in a refrigeration process, for purposes such as preventing freezeout of refrigerants and oil in a refrigeration process. The methods of the present invention are especially useful in very low temperature refrigeration systems or processes, using mixed-refrigerant systems, such as auto-refrigerating cascade cycle, Klimenko cycle, or single expansion device systems. The refrigeration system is comprised of at least one compressor and a throttle cycle of either a single (no phase separators) or multi stage (at least one phase separator) arrangement. Multi stage throttle cycles are also referred to as auto-refrigerating cascade cycles and are characterized by the use of at least one refrigerant vapor-liquid phase separator in the refrigeration process.

The temperature control and freezeout prevention methods of the present invention are useful in a refrigeration system having an extended defrost cycle (bakeout). As will be discussed, the use of a bakeout requires additional consideration, which is addressed by these methods.

An advantage of the present invention is that methods to control the temperature and/or prevent freezeout of the refrigerant mixture are disclosed for use in very low temperature refrigeration systems.

A further advantage of this invention is the stability of systems utilizing the disclosed methods over a range of operating [cool, defrost, standby or bakeout] modes.

Yet another advantage of the invention is the ability to operate the VLTMRS near the freezeout point of the refrigerant mixture.

Still other objects and advantages of the invention will be apparent in the specification.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
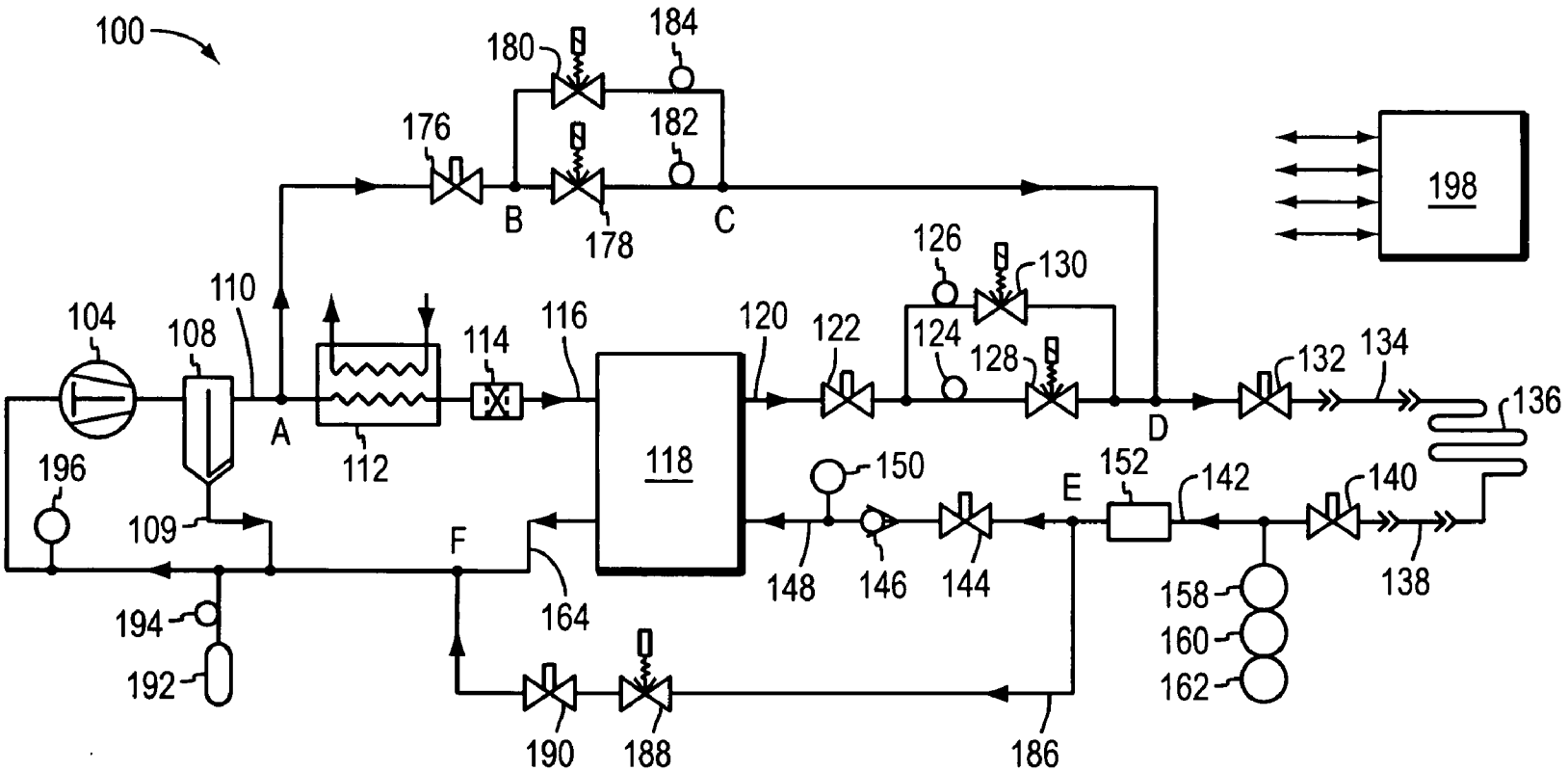
FIG. 1 is a schematic of a very low temperature refrigeration system with bypass circuitry in accordance with the invention.
Figure 2:
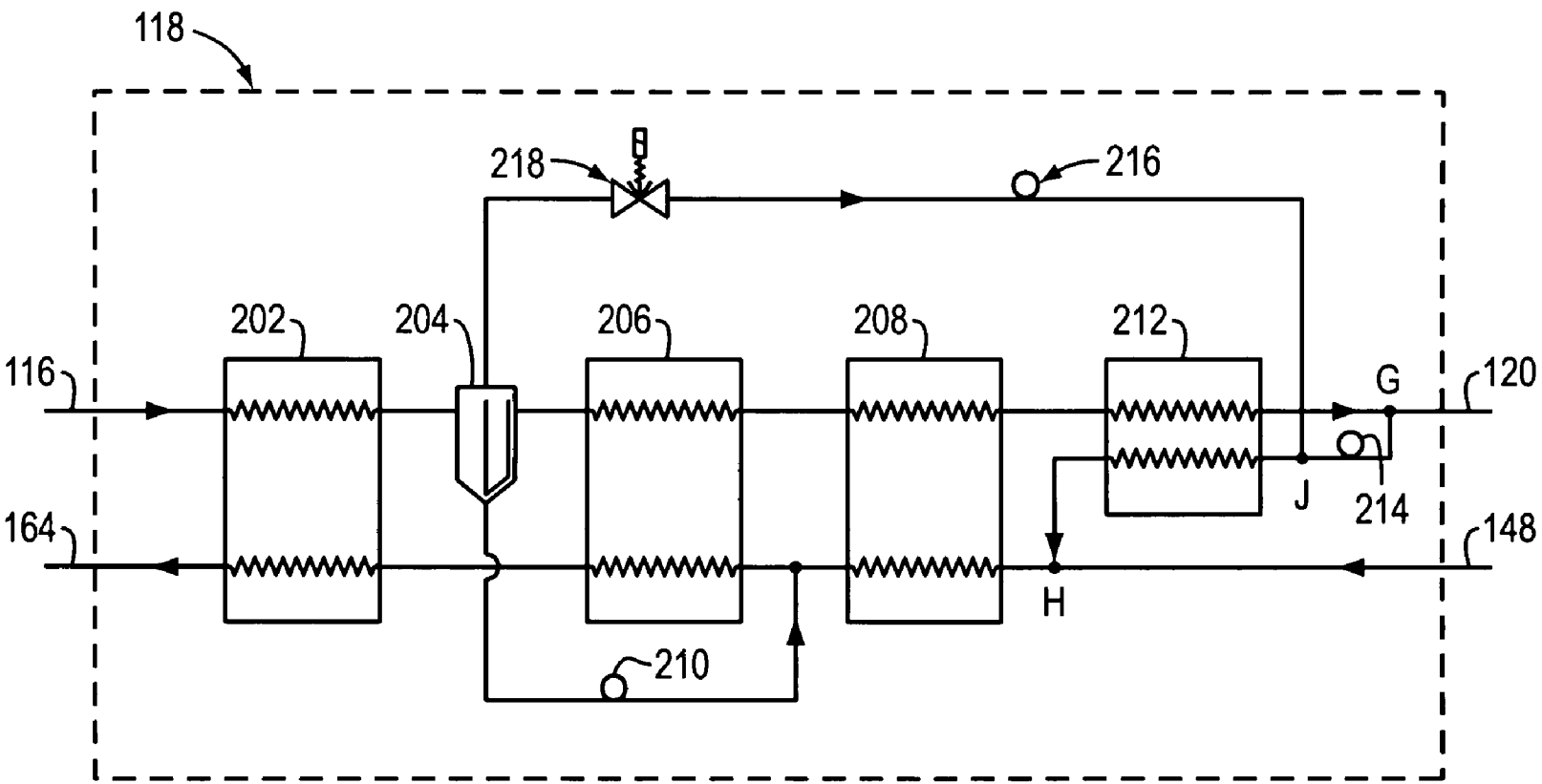
FIG. 2 is a schematic of a method to provide temperature control and/or to prevent freezeout by using a controlled internal bypass of refrigerant in accordance with the invention.

FIG. 1 shows a prior art very low temperature refrigeration system 100 to which features in accordance with the present invention are added. Details of the prior art system are disclosed in U.S. patent application Ser. No. 09/870,385 incorporated herein by reference and made a part hereof. Refrigeration system 100 includes a compressor 104 feeding an inlet of an optional oil separator 108 feeding a condenser 112 via a discharge line 110. Condenser 112 subsequently feeds a filter drier 114 feeding a first supply input of a refrigeration process 118 via a liquid line output 116. Further details of refrigeration process 118 are shown in FIG. 2. An oil separator is not required when oil is not circulated to lubricate the compressor.

Refrigeration process 118 provides a refrigerant supply line output 120 output that feeds an inlet of a feed valve 122. The refrigerant exiting feed valve 122 is high-pressure refrigerant at very low temperature, typically −90 to −208° C. A flow-metering device (FMD) 124 is arranged in series with a cool valve 128. Likewise, an FMD 126 is arranged in series with a cool valve 130. The series combination of FMD 124 and cool valve 128 is arranged in parallel with the series combination of FMD 126 and cool valve 130, where the inlets of FMDs 124 and 126 are connected together at a node that is fed by an outlet of feed valve 122. Furthermore, the outlets of cool valves 128 and 130 are connected together at a node that feeds an inlet of a cryo-isolation valve 132. An outlet of cryo-isolation valve 132 provides an evaporator supply line output 134 that feeds a customer-installed (generally) evaporator coil 136.

The opposing end of evaporator 136 provides an evaporator return line 138 feeding an inlet of a cryo-isolation valve 140. An outlet of cryo-isolation valve 140 feeds an inlet of a very low temperature flow switch 152 via internal return line 142. An outlet of cryogenic flow switch 152 feeds an inlet of a return valve 144. An outlet of return valve 144 feeds an inlet of a check valve 146 that feeds a second input (low pressure) of refrigeration process 118 via a refrigerant return line 148.

A temperature switch (TS) 150 is thermally coupled to refrigerant return line 148 between check valve 146 and refrigeration process 118. Additionally, a plurality of temperature switches, having different trip points, are thermally coupled along internal return line 142. A TS 158, a TS 160, and a TS 162 are thermally coupled to internal return line 142 between cryo-isolation valve 140 and return valve 144.

The refrigeration loop is closed from a return outlet of refrigeration process 118 to an inlet of compressor 104 via a compressor suction line 164. A pressure switch (PS) 196 located in close proximity of the inlet of compressor 104 is pneumatically connected to compressor suction line 164. Additionally, an oil return line 109 of oil separator 108 feeds into compressor suction line 164. Refrigeration system 100 further includes an expansion tank 192 connected to compressor suction line 164. An FMD 194 is arranged inline between the inlet of expansion tank 192 and compressor suction line 164.

A defrost supply loop (high pressure) within refrigeration system 100 is formed as follows: An inlet of a feed valve 176 is connected at a node A located in discharge line 110. A defrost valve 178 is arranged in series with an FMD 182; likewise, a defrost valve 180 is arranged in series with an FMD 184. The series combination of defrost valve 178 and FMD 182 is arranged in parallel with the series combination of defrost valve 180 and FMD 184, where the inlets of defrost valves 178 and 180 are connected together at a node B that is fed by an outlet of feed valve 176. Furthermore, the outlets of FMDs 182 and 184 are connected together at a node C that feeds a line that closes the defrost supply loop by connecting in the line at a node D between cool valve 128 and cryo-isolation valve 132.

A refrigerant return bypass (low pressure) loop within refrigeration system 100 is formed as follows: A bypass line 186 is fed from a node E located in the line between cryogenic flow switch 152 and return valve 144. Connected in series in bypass line 186 are a bypass valve 188 and a service valve 190. The refrigerant return bypass loop is completed by an outlet of service valve 190 connecting to a node F located in compressor suction line 164 between refrigeration process 118 and compressor 104.

With the exception of TS 150, TS 158, TS 160, and TS 162, all elements of refrigeration system 100 are mechanically and hydraulically connected.

A safety circuit 198 provides control to, and receives feedback from, a plurality of control devices disposed within refrigeration system 100, such as pressure and temperature switches. PS 196, TS 150, TS 158, TS 160, and TS 162 are examples of such devices; however, there are many other sensing devices disposed within refrigeration system 100, which are for simplicity not shown in FIG. 1. Pressure switches, including PS 196, are typically pneumatically connected, whereas temperature switches, including TS 150, TS 158, TS 160, and TS 162, are typically thermally coupled to the flow lines within refrigeration system 100. The controls from safety circuit 198 are electrical in nature. Likewise, the feedback from the various sensing devices to safety circuit 198 is electrical in nature.

Refrigeration system 100 is a very low temperature refrigeration system and its basic operation, which is the removal and relocation of heat, is well known in the art. Refrigeration system 100 of the present invention uses pure or mixed refrigerant.

With the exception of cryo-isolation valves 132 and 140, the individual elements of refrigeration system 100 are well known in the industry (i.e., compressor 104, oil separator 108, condenser 112, filter drier 114, refrigeration process 118, feed valve 122, FMD 124, cool valve 128, FMD 126, cool valve 130, evaporator coil 136, return valve 144, check valve 146, TS 150, TS 158, TS 160, TS 162, feed valve 176, defrost valve 178, FMD 182, defrost valve 180, FMD 184, bypass valve 188, service valve 190, expansion tank 192, FMD 194, PS 196, and safety circuit 198). Additionally, cryogenic flow switch 152 is fully described in U.S. application for patent U.S. Ser. No. 09/886,936. For clarity however, some brief discussion of the elements is included below.

Compressor 104 is a conventional compressor that takes low-pressure, low-temperature refrigerant gas and compresses it to high-pressure, high-temperature gas that is fed to oil separator 108.

Oil separator 108 is a conventional oil separator in which the compressed mass flow from compressor 104 enters into a larger separator chamber that lowers the velocity, thereby forming atomized oil droplets that collect on the impingement screen surface or a coalescing element. As the oil droplets agglomerate into larger particles they fall to the bottom of the separator oil reservoir and return to compressor 104 via compressor suction line 164. The mass flow from oil separator 108, minus the oil removed, continues to flow toward node A and onward to condenser 112.

The hot, high-pressure gas from compressor 104 travels through oil separator 108 and then through condenser 112. Condenser 112 is a conventional condenser, and is the part of the system where the heat is rejected by condensation. As the hot gas travels through condenser 112, it is cooled by air or water passing through or over it. As the hot gas refrigerant cools, drops of liquid refrigerant form within its coil. Eventually, when the gas reaches the end of condenser 112, it has condensed partially; that is, liquid and vapor refrigerant are present. In order for condenser 112 to function correctly, the air or water passing through or over the condenser 112 must be cooler than the working fluid of the system. For some special applications the refrigerant mixture will be composed such that no condensation occurs in the condenser.

The refrigerant from condenser 112 flows onward through filter drier 114. Filter drier 114 functions to adsorb system contaminants, such as water, which can create acids, and to provide physical filtration. The refrigerant from filter drier 114 then feeds refrigeration process 118.

Refrigeration process 118 can be any refrigeration system or process, such as a single-refrigerant system, a mixed-refrigerant system, normal refrigeration processes, an individual stage of a cascade refrigeration processes, an auto-refrigerating cascade cycle, or a Klimenko cycle. For the purposes of illustration in this disclosure, refrigeration process 118 is shown in FIG. 2 as a variation of an auto-refrigerating cascade cycle that is also described by Klimenko.

Several items shown in FIG. 1 are not required for a basic refrigeration unit whose sole purpose is to deliver very low temperature refrigerant. The system depicted in FIG. 1 is a system capable of defrost and bakeout fractions. If these functions are not needed then the loops that bypass refrigeration process 118 can be deleted and the essential benefit of the disclosed methods are still applicable. Similarly some of the valves and other devices shown are not required for the disclosed methods to be beneficial. As a minimum though, a refrigeration system must comprise compressor 104, condenser 112, refrigeration process 118, FMD 124, and evaporator 136.

Several basic variations of refrigeration process 118 shown in FIG. 2 are possible. Refrigeration process 118 may be one stage of a cascaded system, wherein the initial condensation of refrigerant in condenser 112 may be provided by low temperature refrigerant from another stage of refrigeration. Similarly, the refrigerant produced by the refrigeration process 118 may be used to cool and liquefy refrigerant of a lower temperature cascade process. Further, FIG. 1 shows a single compressor. It is recognized that this same compression effect can be obtained using two compressors in parallel, or that the compression process may be broken up into stages via compressors in series or a two-stage compressor. All of these possible variations are considered to be within the scope of this disclosure.

Further, the FIGS. 1 through 4 are associated with only one evaporator coil 136. In principle the methods disclosed could be applied to multiple evaporator coils 136 cooled by a single refrigeration process 118. In such a construction, each independently controlled evaporator coil 136 requires a separate set of valves and FMD's to control the feed of refrigerants (i.e. defrost valve 180, FMD 184, defrost valve 178, FMD 182, FMD 126, cool valve 130, FMD 124, and cool valve 128) and the valves required to control the bypass (i.e., check valve 146 and bypass valve 188).

Evaporator 136, as shown, can be incorporated as part of the complete refrigeration system 100. In other arrangements evaporator 136 is provided by the customer or other third parties and is assembled upon installation of the complete refrigeration system 100. Fabrication of evaporator 136 is oftentimes very simple and may consist of copper or stainless steel tubing. In other applications fabrication is more complicated, and is part of a customer process. For example, the evaporator may comprise at least one flow passage in a multiple flow passage heat exchanger. In this arrangement, a customer process fluid flows in other passages of the heat exchanger, and is cooled by the evaporator refrigerant.

Feed valve 176 and service valve 190 are standard diaphragm valves or proportional valves, such as Superior Packless Valves (Washington, Pa.), that provide some service functionality to isolate components if needed.

Expansion tank 192 is a conventional reservoir in a refrigeration system that accommodates increased refrigerant volume caused by evaporation and expansion of refrigerant gas due to heating. In this case, when refrigeration system 100 is off, refrigerant vapor enters expansion tank 192 through FMD 194.

Cool valve 128, cool valve 130, defrost valve 178, defrost valve 180, and bypass valve 188, are standard solenoid valves, such as Sporlan (Washington, Mo.) models xuj, B-6 and B-19 valves. Alternatively, cool valves 128 and 130 are proportional valves with closed loop feedback, or thermal expansion valves.

Optional check valve 146 is a conventional check valve that allows flow in only one direction. Check valve 146 opens and closes in response to the refrigerant pressures being exerted on it. (Additional description of check valve 146 follows. ) Since this valve is exposed to very low temperature it must be made of materials compatible with these temperatures. In addition, the valve must have the proper pressure rating. Further, it is preferred that the valve have no seals that would permit leaks of refrigerant to the environment. Preferably, it should connect via brazing or welding. An example check valve is a series UNSW check valve from Check-All Valve (West Des Moines, Iowa). This valve is only required in those applications requiring a bakeout function.

FMD 124, FMD 126, FMD 182, FMD 184, and FMD 196 are conventional flow metering devices, such as a capillary tube, an orifice, a proportional valve with feedback, or any restrictive element that controls flow.

Feed valve 122, cryo-isolation valves 132 and 140, and return valve 144 are typically standard diaphragm valves, such as manufactured by Superior Valve Co. However, standard diaphragm valves are difficult to operate at very low temperature temperatures because small amounts of ice can build up in the threads, thereby preventing operation. Alternatively, Polycold (Petaluma, Calif.; a division of Brooks Automation, Inc.) has developed an improved very low temperature shutoff valve to be used for cryo-isolation valves 132 and 140 in very low temperature refrigeration system 100. The alternate embodiment of cryo-isolation valves 132 and 140 is described as follows. Cryo-isolation valves 132 and 140 have extension shafts encased in sealed stainless steel tubes that are nitrogen or air filled. A compression fitting and O-ring arrangement at the warm end of the shafts provides a seal as the shafts are turned. As a result, the shafts of cryo-isolation valves 132 and 140 can be turned even at very low temperature temperatures. This shaft arrangement provides thermal isolation, thereby preventing frost buildup.

The evaporator surface to be heated or cooled is represented by evaporator coil 136. Examples of customer installed evaporator coil 136 are a coil of metal tubing or a platen of some sort, such as a stainless steel table that has a tube thermally bonded to it or a table which has refrigerant flow channels machined into it. The flow passage for the evaporator can also be at least one passage of a multi-passage heat exchanger.

FIG. 2 illustrates an exemplary refrigeration process 118 in accordance with the invention. For the purposes of illustration in this disclosure, refrigeration process 118 is shown in FIG. 2 as an auto-refrigerating cascade cycle. However, refrigeration process 118 of very low temperature refrigeration system 100 can be any refrigeration system or process, such as a single-refrigerant system, a mixed-refrigerant system, an individual stage of a cascade refrigeration processes, an auto-refrigerating cascade cycle, a Klimenko cycle, etc.

More specifically, refrigeration process 118 may be an autorefrigerating cascade process system with a single stage cryocooler having no phase separation, (Longsworth, U.S. Pat. No. 5,441,658), a Missimer type autorefrigerating cascade, (Missimer U.S. Pat. No. 3,768,273), or a Klimenko type (i.e., single phase separator) system. Also refrigeration process 118 may be a variation of these processes such as described in Forrest, U.S. Pat. No. 4,597,267 or Missimer, U.S. Pat. No. 4,535,597.

Essential to the invention is that the refrigeration process used must contain at least one means of flowing refrigerant through the refrigeration process during the defrost mode or the standby (no flow to the evaporator) mode. In the case of a single expansion device cooler, or a single refrigerant system, a valve (not shown) and FMD (not shown) are required to allow refrigerant to flow through the refrigeration process from the high-pressure side to the low-pressure side. This ensures that refrigerant flows through the condenser 112 so that heat may be rejected from the system. This also ensures that during defrost low-pressure refrigerant from refrigeration process 118 will be present to mix with the returning defrost refrigerant from line 186. In the stabilized cool mode the internal flow from high side to low side can be stopped by closing this valve for those refrigeration processes that do not require such an internal refrigeration flow path to achieve the desired refrigeration effect (systems that traditionally have a single FMD).

It is critical that the refrigeration process continue to operate even when cooling of the evaporator is not required. Continued operation maintains the very low temperatures in the refrigeration 118 and provides the capability of rapid cooling of the evaporator when needed.

Refrigeration process 118 of FIG. 2 includes a heat exchanger 202, a phase separator 204, a heat exchanger 206, and a heat exchanger 208. In the supply flow path, refrigerant flowing in liquid line 116 feeds heat exchanger 202, which feeds phase separator 204, which feeds heat exchanger 206, which feeds heat exchanger 208, which feeds optional heat exchanger 212. The high-pressure outlet from heat exchanger 212 is split at node G. One branch feeds FMD 214, and the other feeds refrigerant supply line 120. Heat exchanger 212 is known as a subcooler. Some refrigeration processes do not require it and therefore it is an optional element. If heat exchanger 212 is not used then the high-pressure flow exiting heat exchanger 208 directly feeds refrigerant supply line 120. In the return flow path, refrigerant return line 148 feeds heat exchanger 208.

In systems with a subcooler, the low-pressure refrigerant exiting the subcooler is mixed with refrigerant return flow at node H and the resulting mixed flow feeds heat exchanger 208. Low-pressure refrigerant exiting heat exchanger 208 feeds heat exchanger 206. The liquid fraction removed by the phase separator is expanded to low pressure by an FMD 210. Refrigerant flows from FMD 210 and then is blended with the low pressure refrigerant flowing from heat exchanger 208 to heat exchanger 206. This mixed flow feeds heat exchanger 206 which in turn feeds heat exchanger 202, which subsequently feeds compressor suction line 164. The heat exchangers exchange heat between the high-pressure refrigerant and the low-pressure refrigerant.

In more elaborate auto refrigerating cascade systems additional stages of separation may be employed in refrigeration process 118, as described by Missimer and Forrest.

Heat exchangers 202, 206, 208, and 212 are devices that are well known in the industry for transferring the heat of one substance to another. Some common configurations include brazed plate heat exchangers, tube-in-tube heat exchangers, and multiple tubes in a single larger tube. Phase separator 204 is a device that is well known in the industry for separating the refrigerant liquid and vapor phases. Such phase separators use separation elements to effectively remove liquid phase mist from the vapor phase. Typical configurations consist of steel wool packing or stainless steel mist eliminators, which achieve separation efficiencies in excess of 99%, or coalescent media such as packed fiberglass fibers. FIG. 2 shows one phase separator; however, typically there is more than one.

Heat Exchanger 212 is commonly referred to as a subcooler. There is the potential for confusion because conventional refrigeration systems also have a device called a subcooler. In conventional refrigeration a subcooler refers to a heat exchanger using evaporator return gas to cool the condensed discharge refrigerant that enters at room temperature. In such a system, the flow on each side of the heat exchanger is always balanced. On systems depicted in this application, the subcooler serves a different function. It does not exchange heat with returning evaporator refrigerant. Instead, it diverts some high pressure refrigerant from the evaporator and uses it to make the refrigerant destined to the evaporator colder. It is referred to as a subcooler since in some instances it can create a subcooled liquid, however, it functions in a much different manner than a conventional subcooler.

For clarity, for the purposes of this application, a subcooler refers to a heat exchanger employed in a very low temperature mixed refrigerant temperature system and operates by diverting a portion of the coldest high pressure refrigerant in the system to be used to cool the high pressure refrigerant.

The fluid flowing through the heat exchangers in a very low temperature mixed refrigerant process is typically in the form of a two phase mixture at most points of the process. Therefore, maintaining adequate fluid velocity to maintain homogeneity of the mixture is required to prevent the liquid and vapor portions of the flow from separating and degrading the performance of the system. Where a system functions in several operating modes, such as the systems embodying this invention, maintaining sufficient refrigerant flow to properly manage this two phase flow is critical for assuring reliable operation.

With continuing reference to FIGS. 1 and 2, the operation of very low temperature refrigeration system 100 is as follows:

The hot, high-pressure gas from compressor 104 travels through optional oil separator 108 and then through condenser 112 where it is cooled by air or water passing through or over it. When the gas reaches the end of condenser 112, it has condensed partially and is a mixture of liquid and vapor refrigerant.

The liquid and vapor refrigerant from condenser 112 flows through filter drier 114, and then feeds refrigeration process 118. Refrigeration process 118 of very low temperature refrigeration system 100 typically has an internal refrigerant flow path from high to low pressure. Refrigeration process 118 produces very cold refrigerant (−90 to −208° C.) at high pressure that flows to cold gas feed valve 122 via refrigerant supply line 120.

The cold refrigerant exits feed valve 122 and feeds the series combination of FMD 124 and full flow cool valve 128 arranged in parallel with the series combination of FMD 126 and restricted flow cool valve 130, where the outlets of cool valves 128 and 130 are connected together at a node D that feeds the inlet of cryo-isolation valve 132.

Evaporator coil 136 is positioned between cryo-isolation valve 132 and cryo-isolation valve 140, which act as shutoff valves. Cryo-isolation valve 132 feeds evaporator supply line 134, which connects to the evaporator surface to be heated or cooled, i.e. evaporator coil 136. The opposing end of the evaporator surface to be heated or cooled, i.e., evaporator coil 136, connects to evaporator return line 138, which feeds the inlet of cryo-isolation valve 140.

The return refrigerant from evaporator coil 136 flows through cryo-isolation valve 140 to very low temperature flow switch 152.

The return refrigerant flows from the outlet of cryogenic flow switch 152 through return valve 144, and subsequently to check valve 146. Check valve 146 is a spring-loaded cryogenic check valve with a typical required cracking pressure of between 1 and 10 psi. That is to say that the differential pressure across check valve 146 must exceed the cracking pressure to allow flow. Alternatively, check valve 146 is a cryogenic on/off valve, or a cryogenic proportional valve of sufficient size to minimize the pressure drop. The outlet of check valve 146 feeds refrigeration process 118 via refrigerant return line 148. Check valve 146 plays an essential role in the operation of refrigeration system 100 of the present invention.

It should be noted that feed valve 122 and return valve 144 are optional and somewhat redundant to cryo-isolation valve 132 and cryo-isolation valve 140, respectively. However, feed valve 122 and return valve 144 do provide some service functionality to isolate components if needed in servicing the system.

Very low temperature refrigeration system 100 is differentiated from conventional refrigeration systems primarily:

(i) by the very low temperatures that it achieves;

(ii) by the fact that it utilizes a mixture of refrigerants where the mixture is comprised of refrigerants with boiling points that differ by at least 50° C. since these refrigerant mixtures behave much differently than prior art conventional refrigeration systems;

(iii) by the fact that it is used in a system that can operate in more than just a cool mode, i.e. defrost, standby and bakeout modes and thereby need to encompass a wide range of operating conditions; and (iv) by the fact that it provides active techniques of temperature control, such as for preventing refrigerant freezeout, by the methods disclosed in this application.

These differentiations apply to all of the embodiments of this invention discussed in this disclosure.

Examples of specific refrigerants that can be used in the VLTMRS used in this invention are discussed in US applications for patent U.S. Ser. No. 09/728,501, U.S. Ser. No. 09/894,968 and U.S. Pat. No. 5,441,658 (Longsworth) the disclosures of which are incorporated herein and made a part hereof. For completeness, some select mixed refrigerants are (with reference made to "R" numbers as defined by ASHRAE standard number 34) and with a range of potential molar fractions in parenthesis:

Blend A comprising R-123 (0.01 to 0.45), R-124 (0.0 to 0.25), R-23 (0.0 to 0.4), R-14 (0.05 to 0.5), and argon (0.0 to 0.4)

Blend B comprising R-236fa (0.01 to 0.45), R-125 (0.0 to 0.25). R-23 (0.0 to 0.4), R-14 (0.05 to 0.5) and argon (0.0 to 0.4)

Blend C comprising R-245fa, (0.01 to 0.45), R-125 (0.0 to 0.25), R-23 (0.0 to 0.4), R-14 (0.05 to 0.5) and argon (0.0 to 0.4)

Blend D comprising R-236fa (0.0 to 0.45), R-245fa (0.0 to 0.45), R-134a, R-125 (0.0 to 0.25), R-218 (0.0 to 0.25), R-23 (0.0 to 0.4), R-14 (0.05 to 0.5), argon (0.0 to 0.4), nitrogen (0.0 to 0.4) and Neon (0.0 to 0.2)

Blend E comprising propane (0.0 to 0.5), ethane (0.0 to 0.3), methane (0.0 to 0.4), argon (0.0 to 0.4), nitrogen (0.0 to 0.5), and neon (0.0 to 0.3).

It is recognized that the potential combinations of the above blends and blend components is potentially infinite. Also, it is expected that some combinations of different blend components are expected to be useful in some applications. Further, it is expected that other components not listed may be added. However, blends making use of the above components in the above listed ratios, and in combination with other listed blends are within the scope of this invention.

Other mixtures that may be used in very low temperature mixed refrigerant systems in accordance with the invention include the mixtures disclosed in U.S. Pat. No. 6,076,372 and No. 6,502,410, and in U.S. patent application Ser. No. 11/046,655, filed Jan. 28, 2005, entitled "Refrigeration Cycle Utilizing a Mixed Inert Component Refrigerant," the disclosures of which are incorporated herein by reference. Systems operating with a variety of different possible mixtures can benefit from techniques disclosed herein, including mixtures comprising inert refrigerants, fluoroethers, and/or hydrofluorocarbons, and mixtures comprising inert refrigerants, fluoroethers, hydrofluorocarbons, and/or hydrocarbons.

In the case of a conventional refrigeration system where check valve 146 is not present, the return refrigerant goes directly into refrigeration process 118 (in either cool or defrost mode). However, during a defrost cycle, it is typical that refrigeration process 118 is terminated when the return refrigerant temperature to refrigeration process 118 reaches +20° C., which is the typical temperature at the end of the defrost cycle. At that point the +20° C. refrigerant is mixing with very cold refrigerant within refrigeration process 118. The mixing of room temperature and very cold refrigerant within refrigeration process 118 can only be tolerated for a short period of time before refrigeration process 118 becomes overloaded, as there is too much heat being added. Refrigeration process 118 is strained to produce very cold refrigerant while being loaded with warm return refrigerant, and the refrigerant pressure eventually exceeds its operating limits, thereby causing refrigeration process 118 to be shut down by the safety system 198 in order to protect itself. As a result the defrost cycle in a conventional refrigeration system is limited to approximately 2 to 4 minutes and to a maximum refrigerant return temperature of about +20° C.

By contrast however, very low temperature refrigeration system 100 has check valve 146 in the return path to refrigeration process 118 and a return bypass loop around refrigeration process 118, from node E to F, via bypass line 186, bypass valve 188, and service valve 190, thereby allowing a different response to the warm refrigerant returning during a defrost cycle. Like feed valve 122 and return valve 144, service valve 190 is not a requirement but provides some service functionality to isolate components if service is needed.

During a defrost cycle, when the return refrigerant temperature within refrigeration process 118 reaches, for example, −40° C. or warmer due to the warm refrigerant mixing with cold refrigerant, the bypass line from node E to F is opened around refrigeration process 118. As a result, the warm refrigerant is allowed to flow into compressor suction line 164 and then on to compressor 104. Bypass valve 188 and service valve 190 are opened due to the action of TS 158, TS 160, and TS 162. For example, TS 158 is acting as the "defrost plus switch" having a set point of>−25° C. TS 160 (optional) is acting as the "defrost terminating switch" having a set point of>42° C. TS 162 is acting as the "cool return limit switch" having a set point of>−80° C. In general, TS 158, TS 160, and TS 162, respond based on the temperature of the return line refrigerant and based on the operating mode (i.e. defrost or cool mode), in order to control which valves to turn on/off to control the rate of heating or cooling by refrigeration system 100. Some applications require a continuous defrost operation, also referred to as a bakeout mode. In these cases TS 160 is not needed to terminate the defrost since continuous operation of this mode is required.

Essential to the operation is that the differential pressure between nodes E and F, when there is flow through bypass valve 188 and service valve 190, has to be such that the differential pressure across check valve 146 does not exceed its cracking pressure (i.e., 5 to 10 psi). This is important because, by nature, fluids take the path of least resistance; therefore, the flow must be balanced correctly. If the pressure across bypass valve 188 and service valve 190 were allowed to exceed the cracking pressure of check valve 146, then flow would start through check valve 146. This is not desirable because the warm refrigerant would start to dump back into the refrigeration process 118 at the same time that warm refrigerant is entering compressor suction line 164 and feeding compressor 104. Simultaneous flow through check valve 146 and the bypass loop from node E to F would cause refrigeration system 100 to become unstable, and would create a runaway mode in which everything gets warmer, the head pressure (compressor discharge) becomes higher, the suction pressure becomes higher, causing more flow to refrigeration process 118, and the pressure at E becomes even higher, eventually causing shutdown of refrigeration system 100.

This condition can be prevented if a device such as PS 196 is used to interrupt the flow of hot gas to the refrigeration process if the suction pressure exceeds a predetermined value. Since the mass flow rate of refrigeration system 100 is largely governed by the suction pressure, this becomes an effective means of limiting flow rate in a safe range. Fall of the suction pressure below a predetermined limit PS 196 will reset and again permit resumption of the defrost process.

Thus, for proper operation during a defrost cycle of refrigeration system 100, the flow balance through bypass valve 188 and service valve 190, vs. check valve 146 are controlled carefully to provide the proper balance of flow resistance. Design parameters around the flow balance issue include pipe size, valve size, and flow coefficient of each valve. In addition, the pressure drop through the refrigeration process 118 on the suction (low pressure) side may vary from process to process and needs to be determined. The pressure drop in refrigeration process 118 plus the cracking pressure of check valve 146 is the maximum pressure that the defrost return bypass line from E to F can tolerate.

Bypass valve 188 and service valve 190 are not opened immediately upon entering a defrost cycle. The time in which the bypass flow begins is determined by the set points of TS 158, TS 160, and TS 162, whereby the flow is delayed until the return refrigerant temperature reaches a more normal level, thereby allowing the use of more standard components that are typically designed for −40° C. or warmer and avoiding the need for more costly components rated for temperatures colder than −40° C.

Under the control of TS 158, TS 160, and TS 162, the refrigerant temperature of the fluid returning to node F of compressor suction line 164 and mixing with the suction return gas from refrigeration process 118 is set. The refrigerant mixture subsequently flows to compressor 104. The expected return refrigerant temperature for compressor 104 is typically −40° C. or warmer; therefore, fluid at node E being −40° C. or warmer is acceptable, and within the operating limits of the compressor 104. This is another consideration when choosing the set points of TS 158, TS 160, and TS 162.

There are two limits of choosing the set points of TS 158, TS 160, and TS 162. Firstly, the defrost bypass return refrigerant temperature cannot be selected as such a high temperature that refrigeration process 118 shuts itself off because of high discharge pressure. Secondly, the defrost bypass return refrigerant temperature cannot be so cold that the return refrigerant flowing though bypass line 186 is colder than can be tolerated by bypass valve 188 and service valve 190. Nor can the return refrigerant, when mixed at node F with the return of refrigeration process 118, be below the operating limit of the compressor 104. Typical crossover temperature at node E is between −40 and +20° C.

To summarize, the defrost cycle return flow in the refrigeration system 100 does not allow the defrost gas to return to refrigeration process 118 continuously during the defrost cycle. Instead, refrigeration system 100 causes a return bypass (node E to F) to prevent overload of refrigeration process 118, thereby allowing the defrost cycle to operate continuously. TS 158, TS 160, and TS 162 control when to open the defrost return bypass from nodes E to F. In cool mode the defrost return bypass from nodes E to F is not allowed once very low temperatures are achieved.

Having discussed the defrost cycle return path of refrigeration system 100, a discussion of the defrost cycle supply path follows, with continuing reference to FIG. 1. During the defrost cycle, the hot, high-pressure gas flow from compressor 104 is via node A of discharge line 110 located downstream of the optional oil separator 108. The hot gas temperature at node A is typically between 80 and 130° C.

The hot gas bypasses refrigeration process 118 at node A and does not enter condenser 112, as the flow is diverted by opening solenoid defrost valve 178 or solenoid defrost valve 180 and having valves 128 and 130 in a closed condition. As described in FIG. 1, defrost valve 178 is arranged in series with FMD 182; likewise, defrost valve 180 is arranged in series with FMD 184. The series combination of defrost valve 178 and FMD 182 is arranged in parallel between nodes B and C with the series combination of defrost valve 180 and FMD 184. Defrost valve 178 or defrost valve 180 and its associated FMD maybe operated in parallel or separately depending on the flow requirements.

It is important to note that the number of parallel paths, each having a defrost valve in series with an FMD, between nodes B and C of refrigeration system 100 is not limited to two, as shown in FIG. 1. Several flow paths maybe present between nodes B and C, where the desired flow rate is determined by selecting parallel path combinations. For example, there could be a 10% flow path, a 20% flow path, a 30% flow path, etc. The flow from node C is then directed to node D and subsequently through cryo-isolation valve 132 and to the customer's evaporator coil 136 for any desired length of time provided that the return bypass loop, node E to node F, through bypass valve 188 is present. The defrost supply loop from node A to node D is a standard defrost loop used in conventional refrigeration systems. However, the addition of defrost valve 178, defrost valve 180, and their associated FMDs is a unique feature of refrigeration system 100 that allows controlled flow. Alternatively, defrost valves 178 and 180 are themselves sufficient metering devices, thereby eliminating the requirement for further flow control devices, i.e., FMD 182 and FMD 184.

Having discussed the defrost cycle of refrigeration system 100, a discussion of the use of the defrost return bypass loop during the cool cycle follows, with continuing reference to FIG. 1. In the cool mode, bypass valve 188 is typically closed; therefore, the hot refrigerant flows from nodes E to F through refrigeration process 118. However, monitoring the refrigerant temperature of refrigerant return line 142 can be used to cause bypass valve 188 to open in the initial stage of cool mode when the refrigerant temperature at node E is high but falling. Enabling the defrost return bypass loop assists in avoiding further loads to refrigeration process 118 during this time. When refrigerant temperature at node E reaches the crossover temperature, previously discussed (i.e., −40° C. or warmer), bypass valve 188 is closed. Bypass valve 188 is opened using different set points for cool mode vs. bakeout.

Also pertaining to the cool cycle, cool valves 128 and 130 may be pulsed using a "chopper" circuit (not shown) having a typical period about 1 minute. This is useful to limit the rate of change during cool down mode. Cool valve 128 and cool valve 130 have different sized FMDs. Thus the flow is regulated in an open loop fashion, as the path restriction is different through cool valve 128 than through cool valve 130. The path is then selected as needed. Alternatively, one flow path maybe completely open, the other pulsed, etc.

Providing continuous operation of refrigeration system 100 as it is started, and is operated in the standby, defrost, and cool modes requires the proper balancing of the refrigerant components described in this disclosure. If the refrigerant blend does not have the correct components in the correct range of composition, a fault condition will be experienced which causes refrigeration system 100 to be turned off by the control system. Typical fault conditions are low suction pressure, high discharge pressure or high discharge temperature. Sensors to detect each of these conditions are required to be included in refrigeration system 100 and included in the safety interlock of the control system. We have demonstrated that the disclosed methods of freezeout prevention can be successfully applied in various operating modes without causing the unit to shut off on any fault condition.

Reliable operation of a very low temperature mixed refrigerant system (VLTMRS) requires that the refrigerant not freeze. Unfortunately it is difficult to predict when a particular refrigerant mixture will freeze. Application for patent U.S. Ser. No. 09/894,968 discusses specific freezeout temperatures of specific refrigerant blends. The actual freezeout temperature of a mixture can be predicted with various analytical tools provided detailed interaction parameter data is known. However, this data is typically not available, and empirical tests have to be performed to assess the point at which freezeout will occur.

It is possible to conceive of alternative methods of preventing freezeout by utilizing a large bypass of refrigerant around the refrigeration process or by reducing the compressor flow rate so as to limit the amount of refrigeration produced by the refrigeration process 118 when cooling is not needed for the evaporator. The problem with these methods is that the degree to which the refrigerant flow would have to be reduced would prevent the heat exchangers from operating properly as the heat exchangers require a minimum flow rate to support two-phase flow.

Also, as previously disclosed, it is important to maintain very low temperatures in the refrigeration process to support rapid cooling of the evaporator. Therefore, high flow in the heat exchanger must be maintained. However, high flow with no evaporator load results in colder temperatures in refrigeration process 118 which can lead to freezeout.

For a given VLTMRS the evaporator and internal heat exchanger temperatures will vary based on the thermal load on the evaporator and the mode of operation. When in the cool mode, evaporator temperatures may span a range of 50° C. from the highest evaporator load, or maximum rated load (warmest evaporator temperature) to the lowest evaporator load (lowest evaporator temperature). Therefore, optimizing the system hardware and the refrigerant mixture for operation at the maximum rated load may cause problems of freezeout when the system has little or no evaporator load, or when the system has no external load and is operating in the standby, defrost or bakeout mode. This is especially important when the newer HFC refrigerants are used since these refrigerants tend to have warmer freezing points than their CFC and HCFC predecessors. In addition, mixtures using atmospheric gases, inert gases, fluoroethers, and other fluorinated compounds may also experience freezeout. Therefore, a system capable of functioning without freezeout at conditions other than maximum rated load is a critical requirement of VLTMRS users. In addition to preventing freezeout, many applications require the control of the very low temperature provided by the refrigeration system for other purposes. For example, temperature control may be needed to ensure repeatable operation, to prevent damage due to excessively cold temperature, or to control the rate of temperature decrease or increase.

FIG. 2 shows one method of providing temperature control, for purposes such as to prevent refrigerant freezeout, in accordance with the invention. The flow path from phase separator 204 to FMD 216 is controlled by valve 218. This flow is blended at node J with low-pressure refrigerant entering subcooler 212. If no subcooler is used then this flow stream is blended with the coldest low-pressure stream that will exchange heat with the coldest high-pressure refrigerant. For example, if no subcooler were present, this flow stream would blend returning refrigerant from line 148 at node H. The purpose of this bypass is to warm the low-pressure flow; this causes the coldest high-pressure refrigerant to be warmed. The activation of this flow bypass is controlled by valve 218. This valve needs to be rated for the pressures, temperatures and flow rates required for the refrigeration process. As an example, valve 218 is model xuj valve from the Sporlan Valve Company. FMD 216 is any means of regulating the flow as required. In some cases a capillary tube is sufficient. Other applications require an adjustable restriction. In some cases the control and flow regulation features of valve 218 and FMD 216 are combined into a single proportional valve.

Prior art mixed refrigerant very low temperature refrigeration systems similar to those described in this application, lacked valve 218, FMD 216 and the associated bypass loop described herein. It is the use of these components and the associated plumbing shown in FIG. 2 that distinguishes the invention from the prior art.

The selection of a source of warm refrigerant for this freezeout prevention method deserves additional attention. The preferred method, as shown in FIG. 2, is to remove a gas phase from the lowest temperature phase separator in the system. This will typically ensure that the freezeout temperature of this stream is colder than or equal to the freezeout temperature of the stream with which it is mixed. This is a general rule since the lower boiling refrigerants which will be present in higher concentrations at the phase separator typically have colder freezing points. The ultimate criteria is that the blend used to warm the cold end of the refrigeration system 118 must have a freezing temperature at least as low as the stream that it is warming. In some special conditions the resulting mixture will have a freezing point that is warmer or colder than the freezing point of either individual stream. In such a case the criteria is that freezeout does not occur in either stream before or after mixing occurs.

Further, in systems without phase separators, the source of the warm refrigerant could be any high-pressure refrigerant available in the system. Since no phase separators are used the circulating mixture is identical throughout the system, provided a homogeneous mixture of liquid and vapor are supported throughout the system. If the system uses an oil separator, the source of warm refrigerant should be after the phase separator.

Forrest et al., U.S. Pat. No. 4,763,486, describes a method of temperature and capacity control for a VLTMRS that uses liquid condensate from phase separators that are mixed with evaporator inlet. The bypass of liquid condensate is not consistent with the current invention since liquid condensate will be enriched with warmer boiling refrigerants, which are typically the components with the warmest freezing points. Therefore, applying the Forrest et al. process would increase the likelihood of refrigerant freezeout since the resulting mixture would have a warmer freezing point.

Further, the Forrest et al. process requires that the bypass flow enter the evaporator. Therefore, such a method cannot be used in a standby mode or a bakeout mode since this method would cause cooling of the evaporator. In contrast, the standby and bakeout modes require that no evaporator cooling take place.

Forrest et al. does not discuss operation in the proximity of the freezeout temperatures of the mixture. In contrast, Forrest's control method operates at warm temperature and is turned off at temperatures below about −100° C. The temperatures concerning freezeout in VLTMRS are typically −130° C. or colder. Therefore, the methods described by Forrest et al, will not prevent freezeout and will not support operation in the standby or bakeout modes.

In accordance with the teaching of this invention, many other methods of bypassing flow for the purpose of heating are possible. As an example, the liquid from the phase separator, or the two-phase mixture feeding the phase separator could suffice, provided that they have a lower freezing point than the stream with which they are mixed. There are potentially an infinite number of possible combinations of liquid and vapor ratios that could be employed. These combinations can be further expanded by considering mixtures with more than one warm stream mixing together with the cold stream. The essence of this first embodiment of the invention is the routing of a warm stream through one or more flow control devices to blend with low-pressure refrigerant that exchanges heat with the coldest high-pressure refrigerant thereby causing the temperature of the refrigerant to be sufficiently warm such that freezeout does not occur. Also, the first embodiment may be used in techniques of temperature control used for other purposes, as discussed further below.

When an active method of freezeout prevention is used, tests have shown that the method used and the controls used in that method determine whether or not such a bakeout mode can be used in a successful manner. In some cases it was observed that improper balance of the methods disclosed lead to an unstable operation where the suction pressure continues to rise. Even with a control to interrupt bakeout flow via PS 196, it was still observed that the suction pressure would repeatedly reach unacceptably high levels, resulting in an overload of the check valve spring force. Therefore either a series of capillary tubes would be needed, to be used and controlled separately or together to affect varying degrees of flow restriction based on the operating mode and or conditions or alternatively a proportional valve could be used to regulate the flow as needed.

In general, using a flow of gas, or a gas and liquid mixture from a phase separator to FMD 216 provides the simplest means of control. This is because the flow of gas or gas plus liquid through a capillary tube is less sensitive to changes in the downstream pressure. By contrast, flow of liquid through the capillary tube becomes more sensitive to changes in the downstream pressure. Use of a refrigerant mixture that is not fully liquefied when entering FMD 216 enables use of a capillary tube and provides a simple and effective means to prevent freezeout while tolerating significant changes in suction pressure during cool, defrost and bakeout modes.

In general it is preferred that the ratio of gas and liquid fed to the FMD is controlled within some determined limits. Failure to do so will cause variations in the effectiveness of the method when used in an open control loop, especially in the case where the FMD is a fixed restriction such as a capillary tube. However, even with a capillary tube, variations of the inlet ratio can be tolerated provided that the capillary tube was sized with consideration of these variations. In the specific case tested a capillary tube with an internal diameter of 0.044 inches and a length of 36 inches caused a warming of the coldest high-pressure refrigerant of at least 3° C. and as much as 15° C. depending on the operating conditions. This was sufficient to prevent freezeout in any operating mode.

The amount of warming that is needed to prevent freezeout is very small since it is only required to keep the freezeout temperature from being reached. In principle, a temperature of 0.01 degree ° C. is sufficient to prevent freezeout for a mixture whose composition is well known. In other cases, where manufacturing processes, operating conditions, and other variables can cause variation in the mixture composition, a greater margin is needed to ensure that freezeout is prevented. In cases of such uncertainty, the range of possible variation and the impact on freezeout temperature must be assessed. However, in most cases a warming of 5° C. should provide an adequate margin.

The typical range of warming for a method of freezeout prevention will be 0.01 to 30° C. As tested, the methods described in this invention provided warming, relative to the freezeout temperature, of about 3 to 15 C. The typical range, 0.01 to 30° C. of warming, or operation of a VLTMRS within 0.01 to 30° C. of the freezeout temperature, applies regardless of the particular freezeout prevention embodiment being considered, although wider temperature ranges may be used in temperature control embodiments used for other purposes. For example, when used for temperature control for purposes other than freezeout prevention, warming ranges of at least 1, 5, 10, 20, 50, 100, or 150 C may be used. Wider or narrower ranges may also be used, depending on the desired range of temperature control for the application in which the refrigeration system is used.

FIG. 2 provides a schematic representation of the invention utilizing an open loop control method. That is, no control signal is needed to monitor and regulate the operation. The basic control mechanisms are the control valve 218 and FMD 216. Valve 218 is opened based on the mode of operation. The modes requiring temperature control and/or freezeout prevention are determined in the design process and included in the design of the system control. FMD 216 is sized to provide an appropriate amount of flow for the range of operating conditions expected. This approach has the advantage of low implementation cost and simplicity.

An alternative arrangement, in keeping with the invention, is the use of a closed loop feedback control system. Such a system requires a temperature sensor (not shown) at the coldest part of the system where temperature control is to be provided, or where freezeout is to be prevented. This output signal from this sensor is input to a control device (not shown) such as an Omega (Stamford, Conn.) P&ID temperature controller. The controller is programmed with the appropriate set points and its outputs are used to control valve 218.

Valve 218 can be one of several types. It can be either an on/off valve that is controlled by varying the amount of on time and off time. Alternatively valve 218 is a proportional control valve that is controlled to regulate the flow rate. In the case that valve 218 is a proportional control valve FMD 216 may not be needed.

FIG. 2 associates with a VLTMRS that includes subcooler 212. In particular, the mixing location of the warm refrigerant to be used to provide temperature control or to prevent freezeout is shown relative to the subcooler. As previously discussed, the subcooler is optional. Therefore other arrangements are possible in accordance with the invention.

In an alternative embodiment, a system without a subcooler mixes the warm refrigerant with the coldest low-pressure refrigerant location (not shown). It is to be understood that the heat exchangers shown in FIG. 2 are successively colder: Heat exchanger 212 is the coldest, Heat Exchanger 208 is warmer than Heat Exchanger 212, Heat Exchanger 206 is warmer than Heat Exchanger 208, Heat Exchanger 204 is warmer than Heat Exchanger 206 and Heat Exchanger 202 is warmer than Heat Exchanger 204. And of course to provide heat transfer, the high-pressure stream is warmer than the low-pressure stream in each heat exchanger. When no subcooler is present then Heat Exchanger 208, or the last heat exchanger at the cold end of the refrigeration process is by definition the coldest heat exchanger.

It is recognized-that small modifications of the point where the warm refrigerant is mixed with cold refrigerant are possible. It is expected that introducing this refrigerant to mix with any low temperature, low pressure refrigerant will provide some benefit, provided the low temperature refrigerant is no warmer than 20° C. of the coldest low pressure refrigerant and such modifications are within the scope of this invention.

Figure 5:
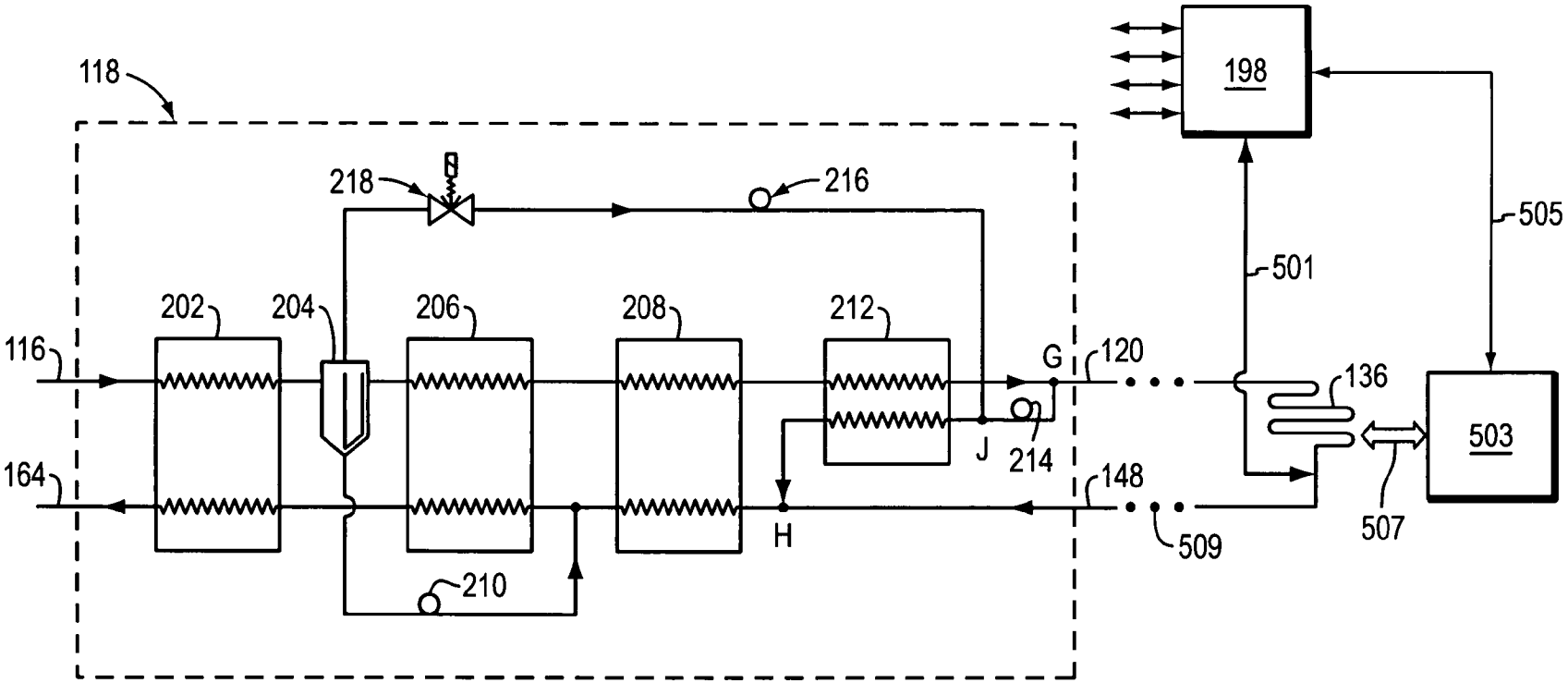
FIG. 5 is a schematic of a method to provide temperature control by using a controlled internal bypass of refrigerant as in the embodiment of FIG. 2, in accordance with the invention.

In addition to providing a technique of freezeout prevention, the first embodiment of FIG. 2 can also be used to provide temperature control of the evaporator for other purposes. In some applications, temperature control is an important requirement of system performance. FIG. 5 illustrates an example of a technique of temperature control in accordance with the first embodiment (of FIG. 2). In FIG. 5, there is provided a technique of controlling the temperature of evaporator 136 or of an object or fluid stream 503 that is being cooled. A temperature control signal 501 provides a measure of the refrigerant temperature in the evaporator 136 (such as an electrical signal) to a control circuit, such as control circuit 198. Although the temperature control signal 501 is shown in FIG. 5 as measuring the temperature at the outlet of the evaporator 136, it is also possible to measure the refrigerant temperature at the inlet of the evaporator 136, or to provide an average, weighted average, or other function of two or more temperature measures over the length of the evaporator coil 136. Alternatively, or in addition to, measuring the temperature of the evaporator 136, a temperature control signal 505 may be used to sense the temperature of the object or fluid 503 that is being cooled. As with the evaporator, a variety of different temperature measures may be used to provide temperature control signal 505, including an average or other function of temperatures throughout the object or fluid 503 that is being cooled. Arrow 507 indicates that evaporator 136 is thermally coupled to the object 503, which may be performed in a variety of different ways depending on the application. Ellipsis 509 indicates that lines 120 and 148 emerging from the refrigeration process 118 are coupled to the evaporator coil 136 via several components (not shown), for example in a similar fashion to the components shown in FIG. 1.

Using the control signals 501 and/or 505, the control circuit 198 determines whether the temperature of the evaporator 136 or object or fluid 503 is too hot or too cold, and provides a control signal to valve 218 to produce more or less warming at point J of the refrigeration process. In such a manner, the temperature of the evaporator 136 or object or fluid 503 may be controlled by closed-loop feedback techniques. The control circuit 198 may combine several inputs 501 and 505, or use just one, to serve as a measure of the temperature that is to be controlled. Also, the control circuit 198 may factor in to its control algorithm secondary inputs from the refrigeration system; for example by placing a secondary limit on the control algorithm based on a measure of the temperature at the coldest point J in the refrigeration process 118.

Although a closed-loop technique of temperature control is shown in FIG. 5, it is also possible to use the embodiment of FIG. 5 to provide temperature control in an open loop fashion, in a similar way to that described above with reference to FIG. 2.

Because the temperature control embodiment of FIG. 5 uses the same bypass circuit through valve 218 and FMD 216 as in FIG. 2, these embodiments are called the "first embodiment," herein.

Figure 3:
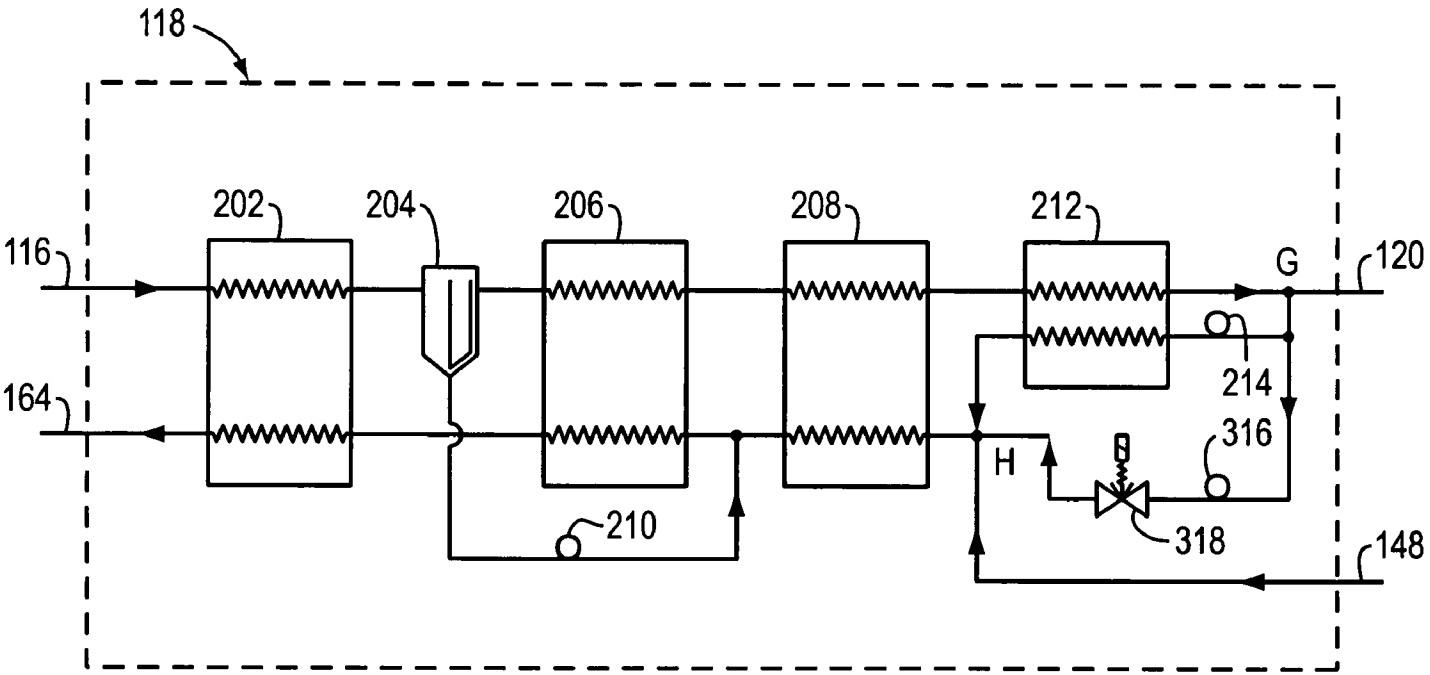
FIG. 3 is a schematic of another alternative method to provide temperature control and/or to prevent freezeout by using a controlled internal bypass of refrigerant in accordance with the invention.

FIG. 3 illustrates a second embodiment of the invention. In this embodiment a different method of controlling temperature and/or preventing freezeout is described. The coldest liquid refrigerant at node G is split to a third branch that feeds valve 318 and FMD 316. The exiting flow from FMD 316 mixes at node H with flows exiting from the subcooler 212 and the return refrigerant stream 148. As in the first embodiment the goal is to eliminate the potential for freezeout, and/or to control temperature for other purposes.

In the second embodiment, temperature is controlled and/or freezeout is prevented or temperature controlled by keeping a lower flow rate of refrigerant through the low-pressure side of subcooler 212 than through the high-pressure side of subcooler 212. This causes the high-pressure flow exiting subcooler 212 to be warmer. Adjusting the ratio of flow that bypasses directly from node G to H causes varying degrees of warming of the refrigerant exiting the high-pressure side of subcooler 212 and consequently causes a warming of the expanded refrigerant entering the low-pressure side of subcooler 212. The more flow that is bypassed around the subcooler, the more temperature control effects are produced, for example producing warmer cold end temperatures.

In contrast, prior art systems did not use this method and had equal flows on both sides of the subcooler, when flow to the evaporator was turned off. This method worked well in systems with a basic defrost method when the FMD 316 consisted of a capillary tube. However, when used on a system with a bakeout mode varying the flow capacity of FMD 316 was required. Therefore either a series of capillary tubes would be needed, to be used and controlled separately or together to effect varying degrees of flow restriction based on the operating mode and or conditions or alternatively a proportional valve could be used to regulate the flow as needed.

FIG. 3 provides a schematic representation in keeping with the invention of an open loop control method. That is, no control signal is needed to monitor and regulate the operation.

The basic control mechanisms are the control valve 318 and FMD 316. Valve 318 is opened based on the mode of operation. The modes requiring temperature control and/or freezeout prevention are determined in the design process and included in the design of the system control. FMD 316 is sized to provide an appropriate amount of flow for the range of operating conditions expected. This approach has the advantage of low implementation cost and simplicity.

An alternative arrangement, in keeping with the invention, is the use of a closed loop feedback control system. Such a system adds a temperature sensor (not shown) at the coldest part of the system where temperature control needs to be provided and/or where freezeout needs to be prevented. This output signal from this sensor is input to a control device (not shown) such as an Omega (Stamford, CT) P&ID temperature controller. The controller is programmed with the appropriate set points and its outputs are used to control valve 318.

Valve 318 can be one of several types. It can be either an on/off valve that is controlled by varying the amount of on time and off time. Alternatively valve 318 is a proportional control valve that is controlled to regulate the flow rate. In the case that valve 318 is a proportional control valve FMD 316 may not be needed.

FIG. 3 shows a VLTMRS that includes subcooler 212. In particular, the source location and mixing location of the warm refrigerant to be used to provide temperature control and/or to prevent freezeout is shown relative to subcooler 212. As previously discussed, subcooler 212 is optional. Therefore other arrangements are possible in accordance with the invention. In an alternative embodiment, a system without a subcooler would divert the coldest high pressure refrigerant and mix the warm refrigerant at the low pressure outlet of the coldest heat exchanger (not shown) such that the coldest heat exchanger has a lower mass flow rate on the low pressure side than on the high pressure side.

It is recognized that small modifications of the point where the warm refrigerant is mixed with cold refrigerant are possible. It is expected that introducing this refrigerant to mix with any low temperature, low pressure refrigerant will provide some benefit, provided the low temperature refrigerant is within 20° C. of the temperature of low pressure refrigerant exiting the coldest heat exchanger and such modifications will be considered to be within the scope of this invention.

Figure 6:
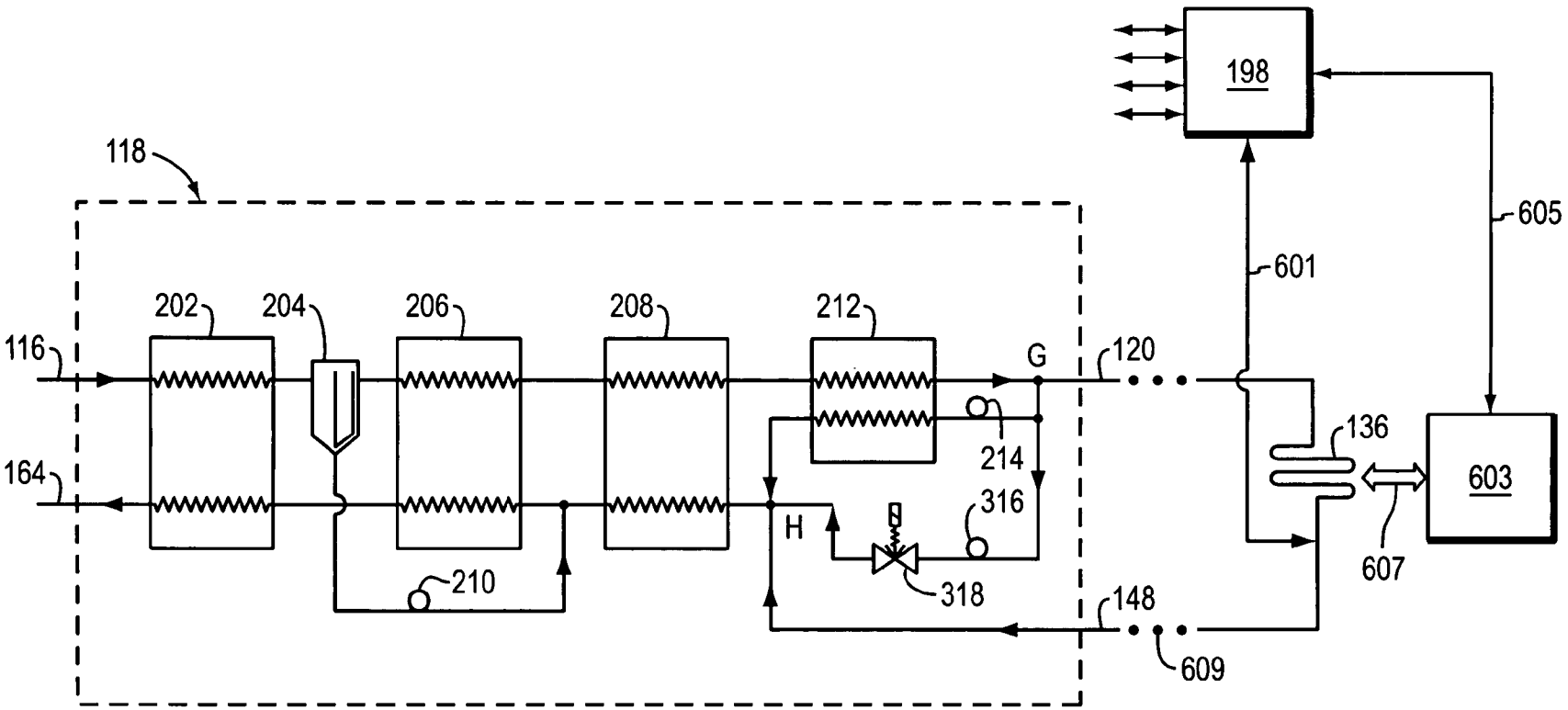
FIG. 6 is a schematic of another alternative method to provide temperature control by using a controlled internal bypass of refrigerant as in the embodiment of FIG. 3, in accordance with the invention.

As with the first embodiment, the second embodiment of FIG. 3 can be used to provide temperature control of the evaporator including for purposes other than freezeout prevention. FIG. 6 illustrates an example of a technique of temperature control in accordance with the second embodiment of FIG. 3. A temperature control signal 601 provides a measure of the refrigerant temperature in the evaporator 136 (such as an electrical signal) to a control circuit, such as control circuit 198, in a similar fashion to control signal 501 of FIG. 5. In a similar fashion to control signal 505 of FIG. 5, a temperature control signal 605 may be used to sense the temperature of the object or fluid 603 that is being cooled. Arrow 607 and ellipsis 609 perform similar functions to items 507 and 509 of FIG. 5, above.

Using the control signals 601 and/or 605, the control circuit 198 may control the temperature of the evaporator 136 or object or fluid 603 using closed-loop feedback techniques, in a similar fashion to that described for FIG. 5. Open loop techniques may also be used, as described above with reference to FIG. 3.

Because the temperature control embodiment of FIG. 6 uses the same bypass circuit through valve 318 and FMD 316 as in FIG. 3, these embodiments are called the "second embodiment," herein.

Figure 4:
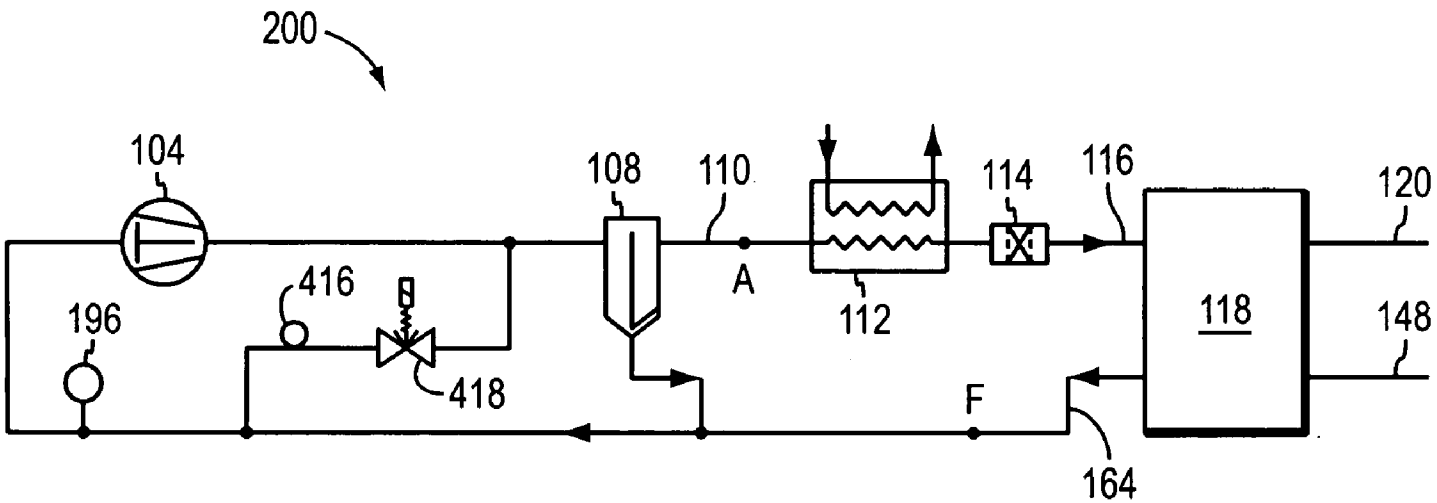
FIG. 4 is a schematic of yet another method to provide temperature control and/or to prevent freezeout by using a controlled bypass of refrigerant in accordance with the invention.

In a third embodiment of the invention, FIG. 4 depicts another alternate method to provide temperature control and/or to manage refrigerant freezeout. In this case modifications are made to components typically located near the compressor. Typically these can be components that operate from room temperature to no colder than −40° C. This is shown as refrigeration system 200, which is modified from refrigeration system 100 by the addition of control valve 418 and FMD 416. This arrangement provides a means to bypass refrigerant flow from high pressure to low pressure and to bypass the refrigeration process 118.

This has a number of effects. Two of these effects, considered to be the most important, are a reduction in the flow rate through the refrigeration process and an increase in the low pressure of the refrigeration system. When a sufficient amount of flow is bypassed through these additional components, warming is elected, resulting in temperature control and/or freezeout prevention in the refrigeration process. However, as disclosed above, if the amount of flow diverted from the refrigeration process is too great, the minimal flow required for good heat exchanger performance will not be maintained. Therefore, the maximum amount of bypass must be limited to ensure sufficient flow in each heat exchanger in the system.

As with the second embodiment, this method worked well for a system with a normal defrost and standby mode (no flow to evaporator), when a fixed tubing was used as the FMD. However, to handle operation in the bakeout mode, such a fixed FMD caused unacceptably high suction pressures. In the specific case tested, a 20 cfm compressor was used. The bypass line with a 0.15" ID was sufficient to prevent freezeout in the bakeout mode and did not cause excessive pressure. However, its use in standby did not provide enough flow. When the tubing was enlarged to ⅜" OD copper tubing, the flow in standby was successful in eliminating freezeout but excessive suction pressures developed in the bakeout mode.

This experience shows that having two or more fixed tube elements operating separately or in combination could be used to manage the requirements of the various operating modes and conditions. Alternatively, a proportional valve such as a thermal expansion valve, or a pressure-regulating valve, such as a crankcase-regulating valve, could be used to modulate the refrigerant flow at the required level.

FIG. 4 provides a schematic representation of the invention with an open loop control method. That is, no control signal is needed to monitor and regulate the operation. The basic control mechanisms are the control valve 418 and FMD 416. Valve 418 is opened based on the mode of operation. The modes requiring temperature control and/or freezeout prevention are determined in the design process and included in the design of the system control. FMD 416 is sized to provide an appropriate amount of flow for the range of operating conditions expected. This approach has the advantage of low implementation cost and simplicity. An alternative arrangement, in keeping with the invention, is the use of a closed loop feedback control system. Such a system adds a temperature sensor (not shown) at the coldest part of the system where temperature is to be controlled and/or where freezeout needs to be prevented. This output signal from this sensor is input to a control device (not shown) such as an Omega (Stamford, Conn.) P&ID temperature controller. The controller is programmed with the appropriate set points and its outputs are used to control valve 418.

Valve 418 can be one of several types. It can be either an on/off valve that is controlled by varying the amount of on time and off time. Alternatively valve 418 is a proportional control valve that is controlled to regulate the flow rate. In the case that valve 418 is a proportional control valve FMD 416 may not be needed.

It is recognized that modifications of the point where the warm refrigerant is mixed on the suction line are possible. It is expected that having this bypass at any temperature at the warmer stages of the process will have the desired goal of raising the suction pressure and reducing the flow rate in the refrigeration process at the cold end. It is expected that this could still provide a benefit provided that the temperature of the bypass refrigerant, at the source or prior to mixing, is warmer than −100° C.

The point where the bypass containing valve 418 is taken off, after compressor 104, may also vary. For instance, the bypass may begin at any point in the high pressure line between compressor 104 and the inlet to refrigeration process 118.

Figure 7:
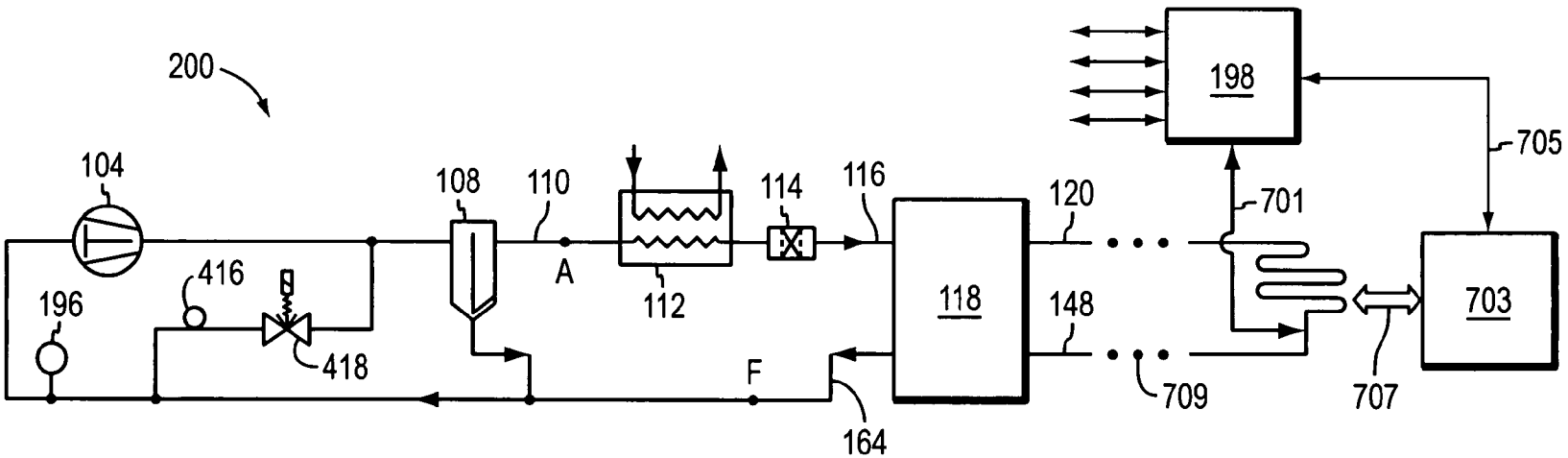
FIG. 7 is a schematic of yet another method to provide temperature control by using a controlled bypass of refrigerant as in the embodiment of FIG. 4, in accordance with the invention.

As with the first and second embodiments, the third embodiment of FIG. 4 can be used to provide temperature control of the evaporator, including for purposes other than freezeout prevention. FIG. 7 illustrates an example of a technique of temperature control in accordance with the third embodiment of FIG. 4. A temperature control signal 701 provides a measure of the refrigerant temperature in the evaporator 136 (such as an electrical signal) to a control circuit, such as control circuit 198, in a similar fashion to control signal 501 of FIG. 5. In a similar fashion to control signal 505 of FIG. 5, a temperature control signal 705 may be used to sense the temperature of the object or fluid 703 that is being cooled. Arrow 707 and ellipsis 709 perform similar functions to items 507 and 509 of FIG. 5, above.

Using the control signals 701 and/or 705, the control circuit 198 may control the temperature of the evaporator 136 or object or fluid 703 using closed-loop feedback techniques, in a similar fashion to that described for FIG. 5. Open loop techniques may also be used, as described above with reference to FIG. 4.

Because the temperature control embodiment of FIG. 7 uses the same bypass circuit through valve 418 and FMD 416 as in FIG. 4, these embodiments are called the "third embodiment," herein.

The first, second, and third embodiments, when used for freezeout prevention, were typically needed in the standby, defrost and bakeout modes for the system they were tested on. In principle and if needed, these methods can also be applied to the cool mode. Likewise, depending on the control method employed, these can be applied on an as needed basis regardless of the operating mode. Similarly, the first, second, and third embodiments for temperature control more generally can be used in standby, defrost, bakeout, and cool modes. When employed for temperature control of the evaporator at very low temperatures, methods of temperature control disclosed herein may be most relevant to operation in the cool mode. However, in the case of systems with two or more independently controlled evaporators, it may be necessary to provide temperature control to one or more evaporators in the cool mode, while one or more other evaporators are in the cool or bakeout modes.

Although the first, second, and third embodiments for temperature control and/or freezeout prevention have been presented separately, it is also possible to use more than one of the above embodiments in the same system, in accordance with the invention. Also, it is possible to use two or more bypasses, each of the two or more bypasses being from the same embodiment of the embodiments described above, in accordance with the invention.

While this invention has been particularly shown and described with references to preferred embodiments thereof, it will be understood by those skilled in the art that various changes in form and details may be made therein without departing from the scope of the invention encompassed by the appended claims.

What is claimed is:

1. A very low temperature refrigeration system utilizing mixed refrigerants, the system comprising:

a compressor in fluid communication with a refrigeration process, the refrigeration process including a high pressure line on a high pressure side of the refrigeration system between the compressor and an evaporator, a low pressure line on a low pressure side of the refrigeration system in a refrigerant return path between the evaporator and the compressor, and at least one heat exchanger cooling refrigerant in the high pressure line from refrigerant in the low pressure line; and a bypass circuit connected either:

a) from a point in the refrigeration process where high pressure refrigerant flows, prior to where the high pressure line exits a cold end of the refrigeration process, and to a point in the refrigeration process where the coldest low pressure refrigerant in the system flows, the bypass circuit including a valve controlling bypass flow of bypassed refrigerant, the result of the bypass flow being to achieve warming of the coldest low pressure refrigerant; or b) from a compressor high-pressure refrigerant line between the compressor and an entrance to the high pressure line of the refrigeration process, and to a suction line of the compressor; or c) from a point in the refrigeration process where high pressure refrigerant is at its coldest temperature, and to a point in the refrigeration process where low pressure refrigerant exits the coldest of the at least one heat exchangers in the refrigeration process, bypassed refrigerant not passing through a heat exchanger between the point where high pressure refrigerant is at its coldest temperature and the point where low pressure refrigerant exits the coldest of the at least one heat exchanger.

2. The refrigeration system of claim 1, wherein the bypass circuit is used to control the temperature of the evaporator.

3. The refrigeration system of claim 2, wherein the bypass circuit is used to make the refrigerant destined for the evaporator warmer.

4. The refrigeration system of claim 2, wherein the bypass circuit is a freezeout prevention circuit.

5. The refrigeration system of claim 1 wherein the bypass circuit comprises a bypass loop connected from the compressor high-pressure refrigerant line between the compressor and the entrance to the high pressure line of the refrigeration process, and to the suction line of the compressor.

6. The refrigeration system of claim 1 wherein the bypass circuit includes a means of controlling fluid flow through the circuit and wherein the fluid flow is controlled utilizing an on-off valve and a flow-metering device.

7. The refrigeration system of claim 6, wherein the fluid flow is controlled utilizing a proportional control valve.

8. The refrigeration system of claim 6 wherein the fluid flow is controlled automatically.

9. The refrigeration system of claim 1 wherein the mixed refrigerant comprises one or more refrigerants selected from the group consisting of R-123, R-245fa, R-236fa, R-124, R-134a, propane, R-125, R-23, ethane, R-14, methane, argon, nitrogen, and neon.

10. The refrigeration system of claim 9 wherein the mixed refrigerant is selected from the group consisting of the following blends each comprising the listed components by range of molar fractions:

Blend A comprising R-123 (0.01 to 0.45); R-124 (0.0 to 0.25), R-23 (0.0 to 0.4), R-14 (0.05 to 0.5), and argon (0.0 to 0.4);

Blend B comprising R-236fa (0.01 to 0.45), R-125 (0.0 to 0.25), R-23 (0.0 to 0.4), R-14 (0.05 to 0.5) and argon (0.0 to 0.4);

Blend C comprising R-245fa (0.01 to 0.45), R-125 (0.0 to 0.25), R-23 (0.0 to 0.4), R-14 (0.05 to 0.5) and argon (0.0 to 0.4);

Blend D comprising R-236fa (0.0 to 0.45), R-245fa (0.0 to 0.45), R-134a (greater than 0.0), R-125 (0.0 to 0.25), R-218 (0.0 to 0.25), R-23 (0.0 to 0.4), R-14 (0.05 to 0.5), argon (0.0 to 0.4), nitrogen (0.0 to 0.4) and Neon (0.0 to 0.2); and Blend E comprising at least one non-zero molar fraction of propane (0.0 to 0.5), ethane (0.0 to 0.3), methane (0.0 to 0.4), argon (0.0 to 0.4), nitrogen (0.0 to 0.5), and neon (0.0 to 0.3).

11. The refrigeration system of claim 1 wherein the bypass circuit is connected from the point in the refrigeration process where warm high pressure refrigerant flows, prior to where the high pressure line exits the refrigeration process, and to a point in the refrigeration process where the coldest low pressure refrigerant in the system flows, the bypass circuit including a valve controlling bypass flow of bypassed refrigerant, the result of the bypass flow being to achieve warming of the coldest low pressure refrigerant.

12. The refrigeration system of claim 1 wherein the bypass circuit is connected from the point in the refrigeration process where high pressure refrigerant is at its coldest temperature, and to the point in the refrigeration process where low pressure refrigerant exits the coldest of the at least one heat exchangers in the refrigeration process, bypassed refrigerant not passing through a heat exchanger between the point where high pressure refrigerant is at its coldest temperature and the point where low pressure refrigerant exits the coldest of the at least one heat exchangers.

13. A refrigeration system, the system comprising:

a compressor;

a refrigeration process in fluid communication with the compressor, the refrigeration process including a high pressure line on a high pressure side of the refrigeration system between the compressor and an evaporator, a low pressure line on a low pressure side of the refrigeration system in a refrigerant return path between the evaporator and the compressor, and at least one heat exchanger cooling refrigerant in the high pressure line from refrigerant in the low pressure line;

an expansion device receiving high pressure refrigerant from the refrigeration process; and a bypass circuit bypassing at least a portion of the refrigeration process and being connected to flow refrigerant into a point in the refrigeration process, the bypass circuit including a valve controlling bypass flow of bypassed refrigerant, the result of the bypass flow being to achieve warming of the coldest low pressure refrigerant in the system;

the system using the mixed refrigerant to provide refrigeration at temperatures below 183K.

14. A refrigeration system according to claim 13, wherein the bypass circuit is used to control the temperature of the evaporator.

15. A refrigeration system according to claim 14, wherein the bypass circuit is used to make the refrigerant destined for the evaporator warmer.

16. A refrigeration system according to claim 14, wherein the bypass circuit is a freezeout prevention circuit.

17. A refrigeration system according to claim 13, wherein the bypass circuit is to a cold point at a lower pressure in the refrigeration process, from a warmer point at a higher pressure.

18. A refrigeration system according to claim 17, wherein the bypass circuit includes a flow restriction.

19. A refrigeration system according to claim 13, wherein the system uses the mixed refrigerant to provide refrigeration at temperatures above 65 K.

20. A refrigeration system according to claim 13, wherein the mixed refrigerant comprises at least two component refrigerants having widely spaced normal boiling points.

21. A refrigeration system according to claim 20, wherein the mixed refrigerant comprises at least two component refrigerants whose normal boiling points differ by at least 50° C.

* * * * *